US009408513B2

(12) United States Patent
Elen

(10) Patent No.: US 9,408,513 B2
(45) Date of Patent: Aug. 9, 2016

(54) MOTORIZED SCRUBBING, BUFFING, AND POLISHING TOOL

(71) Applicant: Carine Elen, New Paltz, NY (US)

(72) Inventor: Carine Elen, New Paltz, NY (US)

( * ) Notice: Subject to any disclaimer, the term of this patent is extended or adjusted under 35 U.S.C. 154(b) by 18 days.

(21) Appl. No.: 14/366,176

(22) PCT Filed: Dec. 19, 2012

(86) PCT No.: PCT/IB2012/002945

§ 371 (c)(1),
(2) Date: Jun. 17, 2014

(87) PCT Pub. No.: WO2013/093619

PCT Pub. Date: Jun. 27, 2013

(65) Prior Publication Data

US 2014/0357165 A1 Dec. 4, 2014

Related U.S. Application Data

(60) Provisional application No. 61/577,653, filed on Dec. 19, 2011.

(51) Int. Cl.
*B24B 29/00* (2006.01)
*A47L 11/10* (2006.01)
(Continued)

(52) U.S. Cl.
CPC ..... *A47L 11/10* (2013.01); *A47L 11/12* (2013.01); *A47L 11/4005* (2013.01);
(Continued)

(58) Field of Classification Search
CPC ..... B24B 23/04; B24B 29/00; B25F 5/00; B25F 5/006; A47L 11/10; A47L 11/12; A47L 11/4005; A47L 11/4008; A47L 11/4075; A47L 1/05; A47L 11/00; A47L 11/02; A47L 11/03; A47L 11/125; A47L 11/40; A46B 13/00; A46B 13/02; A46B 13/023; A46B 13/04; Y10T 16/469; Y10T 16/4713
USPC ..... 451/344, 356–359; 15/22.1, 22.2, 28, 15/97.1; 16/422
See application file for complete search history.

(56) References Cited

U.S. PATENT DOCUMENTS 2,722,790 A * 11/1955 Smith ..... 451/356
2,775,076 A * 12/1956 Roods ..... 451/356
(Continued)

FOREIGN PATENT DOCUMENTS

WO WO 2013093619 A2 6/2013

OTHER PUBLICATIONS

European Patent Office, International Search Report and Written Opinion, PCT/ISA/220, Application No. PCT/IB2012/002945, Oct. 25, 2013, European Patent Office, Rijswijk, Netherlands.

*Primary Examiner* — George Nguyen
(74) *Attorney, Agent, or Firm* — Thomas P. O'Connell; O'Connell Law Firm

(57) ABSTRACT

A submersible, buoyant, and adaptable motorized tool for scrubbing, buffing, and polishing with a housing with a water-tight inner volume, a motor retained within the housing, a rechargeable battery for providing electrical power to the motor, a switch, a base member moved in response to an operation of the motor, and a boat-shaped surface treatment pad releasably retained in relation to the base member. The housing has an upper portion formed as a bulbous knob with an anterior end beyond which an anterior end of the surface treatment pad projects. A heat sink has heat sink arms that have flanges received into apertures in the housing for removing heat from the motor. A liquid-dispensing reservoir removably engages the body portion of the motorized tool.

27 Claims, 17 Drawing Sheets

(51) Int. Cl.

| | |
|---|---|
| ***A47L 11/12*** | (2006.01) |
| ***A47L 11/40*** | (2006.01) |
| ***B24B 23/04*** | (2006.01) |
| ***B25F 5/00*** | (2006.01) |

(52) U.S. Cl.

CPC ..... *A47L 11/4008* (2013.01); *A47L 11/4075* (2013.01); *B24B 23/04* (2013.01); *B24B 29/00* (2013.01); *B25F 5/00* (2013.01); *B25F 5/006* (2013.01)

(56) References Cited

U.S. PATENT DOCUMENTS

| | | | | | |
|---|---|---|---|---|---|
| 3,176,436 | A | * | 4/1965 | Anton | 451/355 |
| 3,579,915 | A | * | 5/1971 | Satterthwaite et al. | 451/271 |
| 4,158,246 | A | * | 6/1979 | Meadows et al. | 15/28 |
| 4,463,525 | A | * | 8/1984 | Sheber | 451/344 |
| 5,038,523 | A | * | 8/1991 | Farber et al. | 451/344 |
| 5,150,492 | A | * | 9/1992 | Suroff | 15/22.1 |
| 5,289,605 | A | * | 3/1994 | Armbruster | 15/97.1 |
| 5,398,457 | A | * | 3/1995 | Updegrave et al. | 451/415 |
| 5,423,102 | A | | 6/1995 | Madison | |
| 5,701,625 | A | | 12/1997 | Siman | |
| 5,759,094 | A | * | 6/1998 | Bosten et al. | 451/356 |
| 5,960,503 | A | | 10/1999 | Del Pozo Y Mattei | |
| 6,022,267 | A | * | 2/2000 | Chyn | 451/344 |
| 6,149,096 | A | * | 11/2000 | Hartley | 242/390.9 |
| 6,292,971 | B1 | | 9/2001 | Chaudray | |
| 6,306,024 | B1 | * | 10/2001 | Kai et al. | 451/357 |
| 6,676,499 | B1 | * | 1/2004 | Stewart, II | 451/359 |
| 7,101,274 | B1 | * | 9/2006 | Etter et al. | 451/344 |
| 7,220,174 | B2 | * | 5/2007 | Phillips et al. | 451/354 |
| 7,261,623 | B1 | * | 8/2007 | Palushi | 451/350 |
| 7,284,292 | B2 | | 10/2007 | Jaffe | |
| 7,285,038 | B1 | * | 10/2007 | Jioia | 451/28 |
| D573,857 | S | | 7/2008 | Stratford et al. | |
| 7,571,517 | B2 | * | 8/2009 | Smith et al. | 16/436 |
| 7,596,872 | B2 | * | 10/2009 | Clarke et al. | 30/391 |
| 7,631,386 | B1 | | 12/2009 | Santiago et al. | |
| 7,707,674 | B2 | | 5/2010 | Schonewille et al. | |
| 8,122,554 | B2 | | 2/2012 | Schemmel et al. | |
| 8,226,454 | B2 | * | 7/2012 | Chen | 451/7 |
| 8,261,398 | B2 | * | 9/2012 | Haigh et al. | 15/145 |
| 8,484,805 | B2 | * | 7/2013 | Munari | 16/425 |
| 2003/0017796 | A1 | * | 1/2003 | Walker | 451/357 |
| 2003/0171079 | A1 | * | 9/2003 | How et al. | 451/53 |
| 2004/0043704 | A1 | * | 3/2004 | Saberton | 451/38 |
| 2004/0074025 | A1 | | 4/2004 | Blaustein et al. | |
| 2004/0103490 | A1 | | 6/2004 | Long et al. | |
| 2004/0123410 | A1 | * | 7/2004 | Terry et al. | 15/23 |
| 2005/0183222 | A1 | * | 8/2005 | Grohe, Jr. | 15/49.1 |
| 2006/0068689 | A1 | | 3/2006 | Kiss et al. | |
| 2006/0172668 | A1 | * | 8/2006 | Hofmann et al. | 451/359 |
| 2007/0082590 | A1 | * | 4/2007 | Kraenzler et al. | 451/359 |
| 2008/0090504 | A1 | * | 4/2008 | Trautner et al. | 451/359 |
| 2008/0091326 | A1 | * | 4/2008 | Watanabe et al. | 701/70 |
| 2008/0254721 | A1 | * | 10/2008 | Wuensch | 451/344 |
| 2009/0090763 | A1 | * | 4/2009 | Zemlok et al. | 227/175.2 |
| 2009/0221222 | A1 | * | 9/2009 | Lo et al. | 451/359 |
| 2010/0009608 | A1 | * | 1/2010 | Lo et al. | 451/357 |
| 2010/0048101 | A1 | * | 2/2010 | King et al. | 451/28 |
| 2010/0105301 | A1 | * | 4/2010 | Whelan | 451/359 |
| 2010/0115730 | A1 | * | 5/2010 | Holland et al. | 16/422 |
| 2010/0178856 | A1 | * | 7/2010 | Cruz | 451/356 |
| 2012/0045976 | A1 | * | 2/2012 | Roser et al. | 451/358 |
| 2013/0084193 | A1 | * | 4/2013 | Beers et al. | 417/44.1 |

* cited by examiner

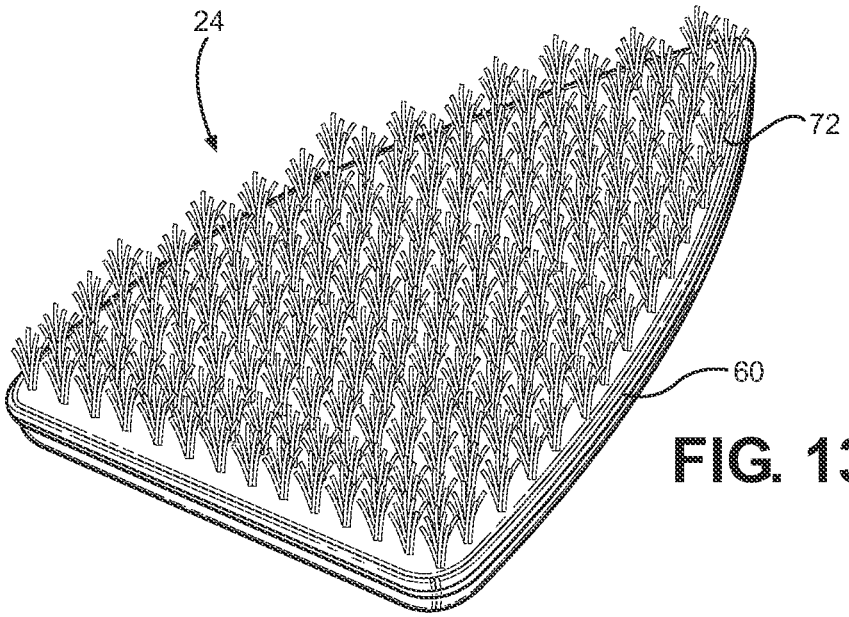
FIG. 13A
FIG. 13B
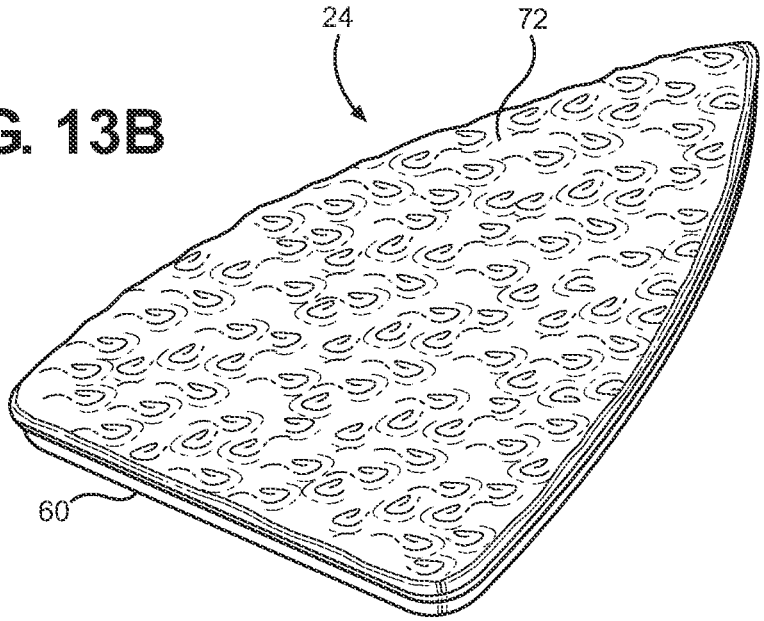

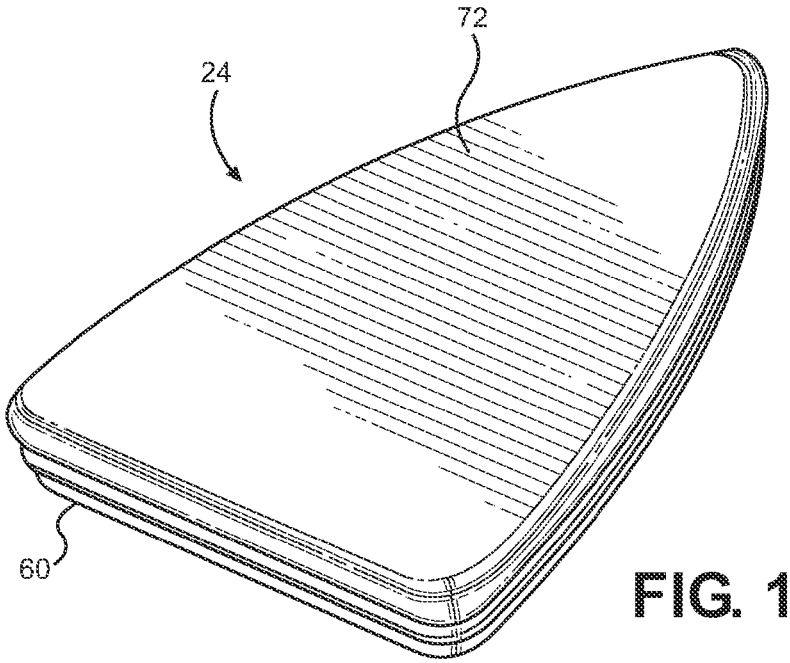
FIG. 13C
FIG. 13D
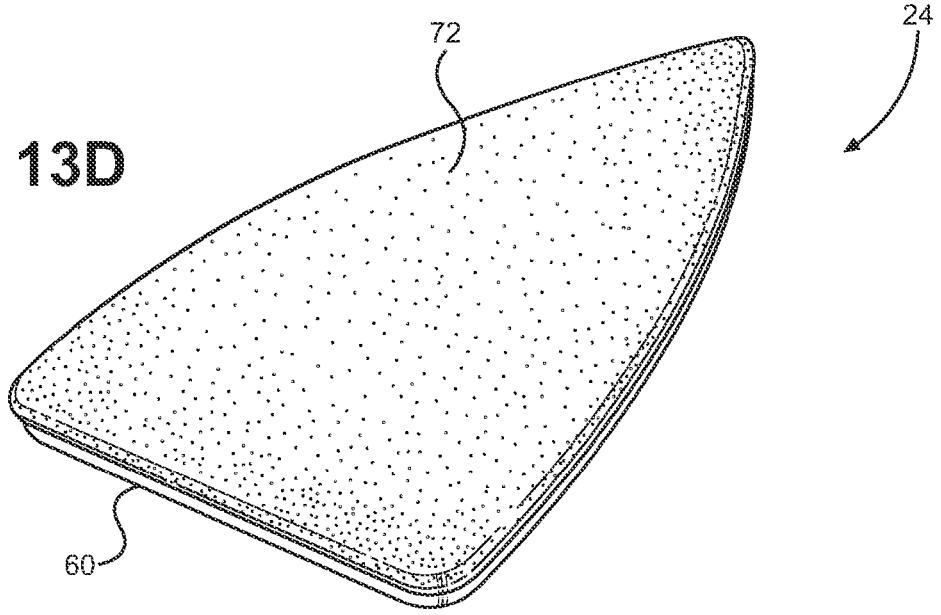

MOTORIZED SCRUBBING, BUFFING, AND POLISHING TOOL

CROSS-REFERENCE TO RELATED APPLICATION

This application claims the benefit of U.S. Provisional Patent Application No. 61/577,653, filed 19 Dec. 2011, which is hereby incorporated by reference herein.

TECHNICAL FIELD

The present invention relates generally to motorized tools. More particularly, disclosed herein is a waterproof, motorized scrubbing, buffing, and polishing tool of ergonomic configuration with interchangeable surface treatment pads for permitting varied surface treatments.

BACKGROUND OF THE INVENTION

It will be recognized that the prior art has disclosed numerous hand tools and methods for cleaning, polishing, and buffing household and similar surfaces. Most basically, for example, sponges with smooth and abrasive surfaces have been taught where a user can clean, polish, and buff a surface with sheer elbow grease. However, such methods and devices are cumbersome and often of limited effectiveness.

Motorized handheld cleaning tools are also disclosed by the prior art. For example, U.S. Pat. No. 7,707,674 to Schonewille et al. discloses a motorized handheld scrubbing tool. There, the scrubbing tool has a housing with a battery-powered motor that drives an output shaft. The output shaft in turn propels a cleaning attachment. The Schonewille et al. patent further includes a liquid delivery system that is quite complicated in structure and function with piston and valve assemblies and a pressurized reservoir for dispensing liquid household cleaners. In a similar vein, U.S. Pat. No. 5,701,625 to Siman teaches a motorized scrubbing machine that seeks to reduce the effort required for cleaning by use of rotating pads or brushes. Under the Siman invention, water and detergent can be supplied from a pipe inlet to pass through the pads for cleaning and rinsing.

These and further inventions have contributed usefully to the state of the art. However, it will be recognized that they are complex in construction and function. Moreover, these and similar cleaning tools are limited in their functionality and adaptability.

In view of the shortcomings of the prior art, the present inventor has appreciated that there is a recognized need for an improved motorized tool that can permit scrubbing, buffing, and polishing to be carried out efficiently and effectively in varied applications and in relation to multiple different surfaces and difficult to reach locations through tool adaptability and improved functionality, all with reduced manual effort by the user.

SUMMARY DISCLOSURE OF THE INVENTION

Accordingly, the present invention was founded on the basic object of creating a motorized cleaning scrubbing, buffing, and polishing tool that permits such tasks to be carried out efficiently and effectively with reduced user effort. A further object of embodiments of the invention is to provide a motorized tool with an ergonomic configuration that can be gripped and manipulated comfortably and effectively and that can additionally or alternatively be retained and manipulated by an elongate handle for use as a floor model or otherwise for extended access. Still another object of embodiments of the invention is to provide a motorized tool with interchangeable surface treatment pads for permitting varied surface treatments, including scrubbing, buffing, and polishing. A further object of embodiments of the invention is to provide a motorized tool that is watertight and, ideally, buoyant for use in wet applications, including bath, kitchen, outdoor, and marine applications.

These and further objects and advantages of embodiments of the invention will become obvious not only to one who reviews the present specification and drawings but also to those who have an opportunity to enjoy the use of an embodiment of the motorized tool disclosed herein. However, it will be appreciated that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the present invention.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF THE DRAWINGS

In the accompanying drawings:

FIGS. 13A, 13B, 13C, and 13D are perspective views of alternative surface treatment pads;

DETAILED DESCRIPTION

The present invention for a motorized tool is subject to widely varied embodiments. However, to ensure that one skilled in the art will be able to understand and, in appropriate cases, practice the present invention, certain preferred embodiments of the broader invention revealed herein are described below and shown in the accompanying drawing figures.

Figure 1:
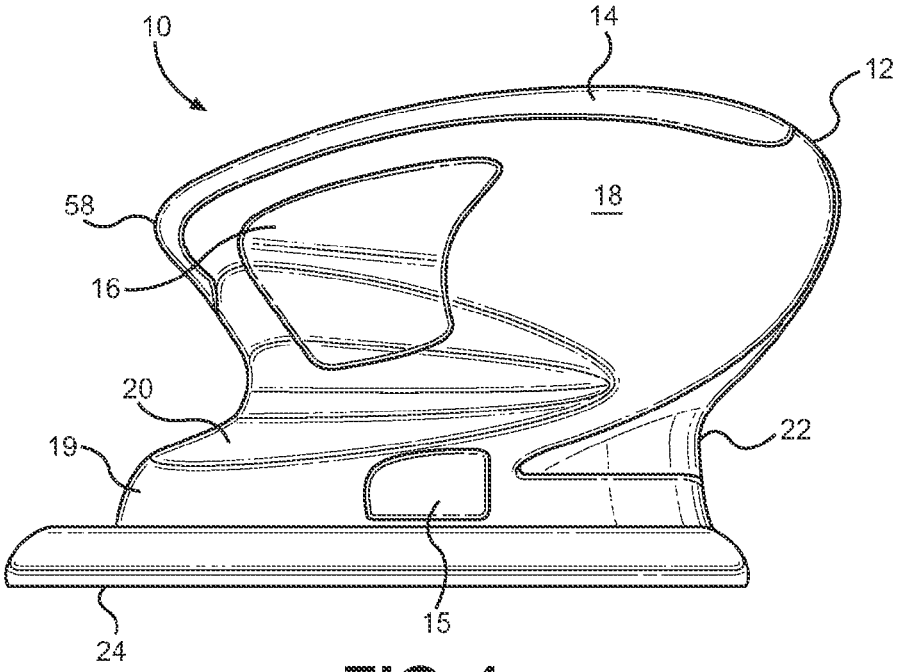
FIG. 1 is a view in side elevation of a motorized tool as disclosed herein.
Figure 2:
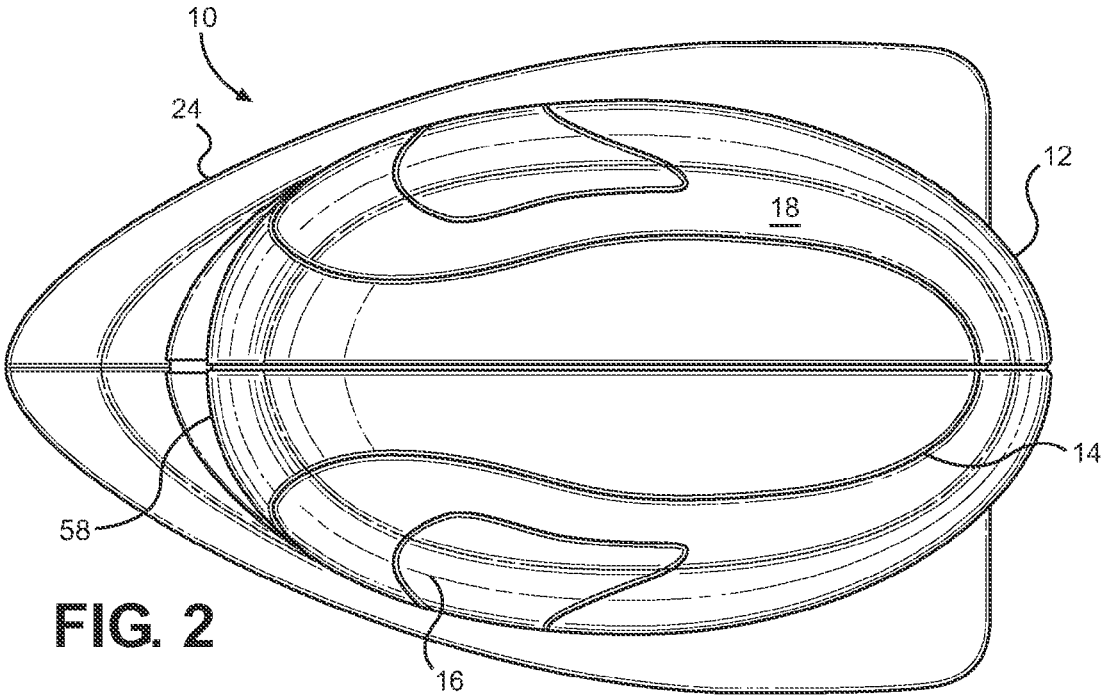
FIG. 2 is a top plan view of the motorized tool of FIG. 1.
Figure 3:
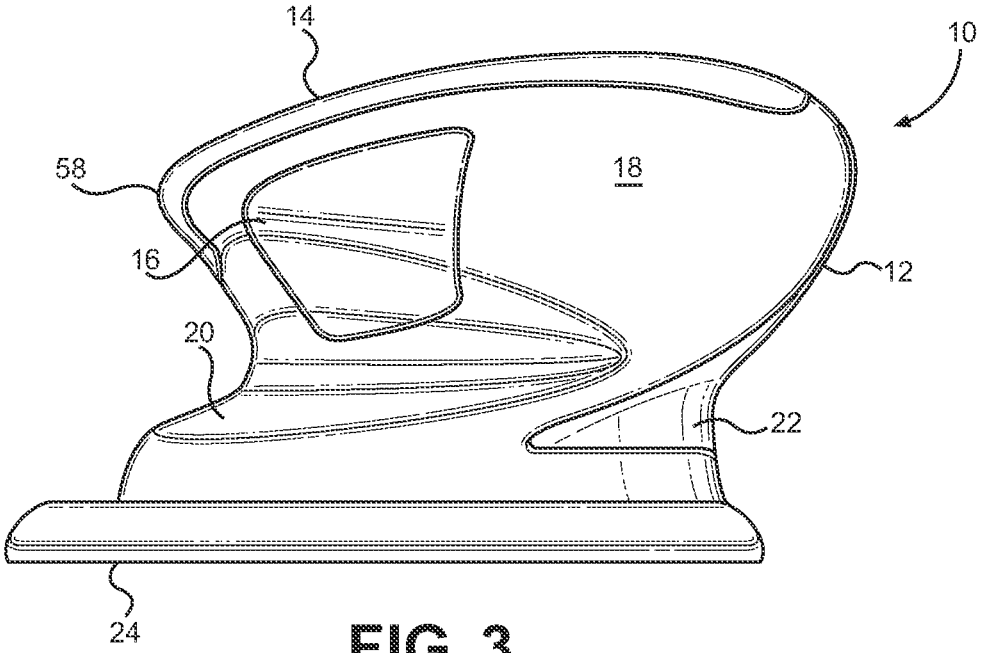
FIG. 3 is a view in side elevation of the motorized tool pursuant to the present invention.
Figure 4:
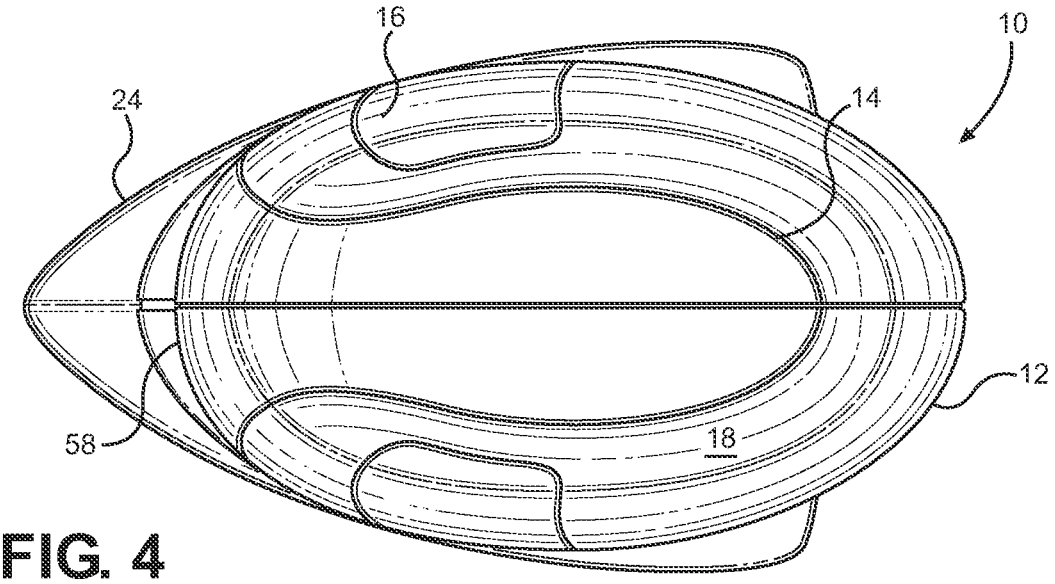
FIG. 4 is a top plan view of the motorized tool of FIG. 1.

Turning more particularly to the drawings, a first embodiment of the motorized tool disclosed herein is indicated generally at 10 in FIGS. 1 and 2. There, the motorized tool 10 is founded on a housing 12. As can be seen with additional reference to FIG. 8, the housing 12 in this embodiment is formed of first and second housing halves 12A and 12B. The housing can be formed, such as by molding or any other method, of a durable material, whether it be plastic, metal, or some other material or combination thereof. In one contemplated embodiment, the housing 12 is formed from injection-molded acrylonitrile butadiene styrene (ABS) plastic with a haircell texture.

As depicted, the housing 12 has a knob-like, bulbous upper portion 18, a broadened base portion 19, and a contoured narrowed portion with a recessed mid-portion 20 therebetween. The upper portion 18 of the housing 12 can be considered to have an anterior portion, which terminates in a tip 58, and a posterior portion. When the tool 10 is disposed in a flat, upright disposition with a surface treatment pad 24 retained relative to the base portion 19 as in FIG. 1, the base portion 19 of the housing 12 projects beyond the tip 58, such as by approximately 1.3 inches in particular embodiments. With that, the tool 10 can be operated without the user's fingers being scraped or crushed against a work surface. Immediately below the tip 58, the housing 12 has the recessed mid-portion 20 to promote gripping by a user. Immediately below the posterior portion of the upper portion 18 of the housing 12 is a charging cradle slot 22, which will be described further hereinbelow. The charging cradle slot 22 is recessed in relation to the posterior portion of the upper portion 18 whereby the upper portion 28 presents a larger, bulbous member as the upper portion 18 in comparison to the narrowed portion presented by the recess 20 in combination with the recessed charging cradle slot 22.

Textured gripping sections 14, 15, and 16 of high friction, vibration absorbing material are retained relative to the housing 12 to permit the motorized tool 10 to be gripped and manipulated most effectively and comfortably. Moreover, the textured gripping sections 14, 15, and 16 ensure positive gripping even when the tool 10 is wet and/or slippery. In one embodiment, the gripping sections 14, 15, and 16 are of low durometer, high friction material, such as textured rubber. The gripping sections 14, 15, and 16 could be disposed and retained in any effective manner within the scope of the invention except as it might expressly be limited.

In the present embodiment, the gripping sections 14, 15, and 16 are overmolded in relation to the housing 12. The central gripping section 14 spans from the top of the upper portion of the housing 12 beyond a midpoint thereof and anteriorly to overlie the anterior portion of the housing 12, including the tip 58. First and second lateral gripping sections 16 are disposed to opposite sides of the bulbous upper portion 18 of the housing 12 and span above and below the broadest portion thereof at their longitudinal position on the housing 12. Finally, the base gripping portions 15 provide affirmative gripping surfaces along the base portion 19 of the housing 12 generally at a mid-portion thereof. Moreover, as described further hereinbelow, the base gripping portions 15 act as release/eject buttons that permit a user to eject or release surface treatment pads 24 automatically for cleaning or replacement.

Figure 5:
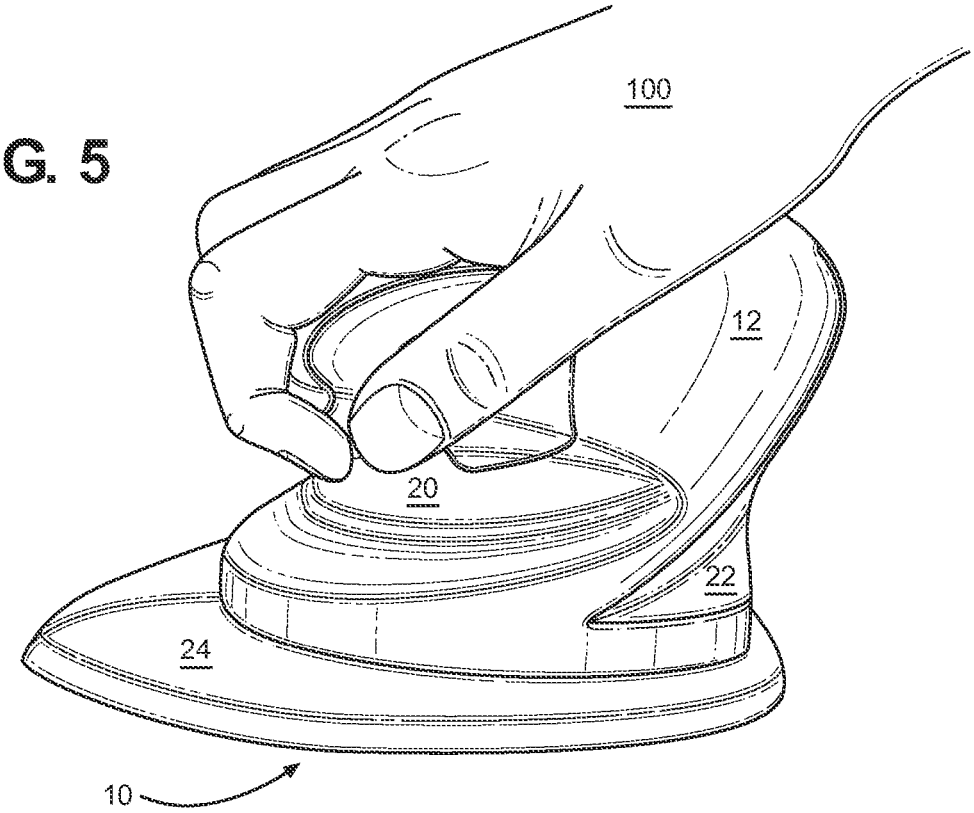
FIG. 5 is a perspective view of a model of the motorized tool disclosed herein being gripped by a user.
Figure 6:
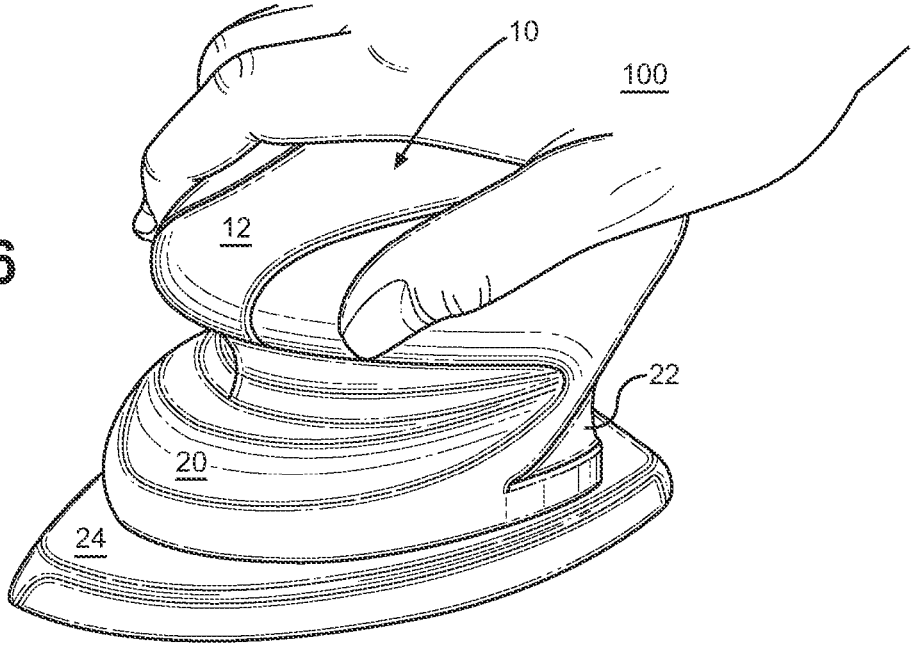
FIG. 6 is a perspective view of the model of the motorized tool disclosed herein being alternatively gripped by a user.

Under this arrangement, the motorized tool 10 can be effectively gripped in an over-handed fashion with the user's hand generally centered in relation to a longitudinal centerline of the tool 10 with the forefingers of the user's hand 100 overlying the tip 58 of the anterior portion of the housing 12 as in FIG. 5. The motorized tool 10 can also be gripped effectively as in FIG. 6 where the thumb of the user's hand 100 engages the left side gripping section 16 and the user's forefinger and potentially subsequent fingers would engage the right side gripping section 16. As constructed, the motorized tool 10 has at least a 15-25 degree zone over which gripping is particularly sound ergonomically.

Figure 7A:
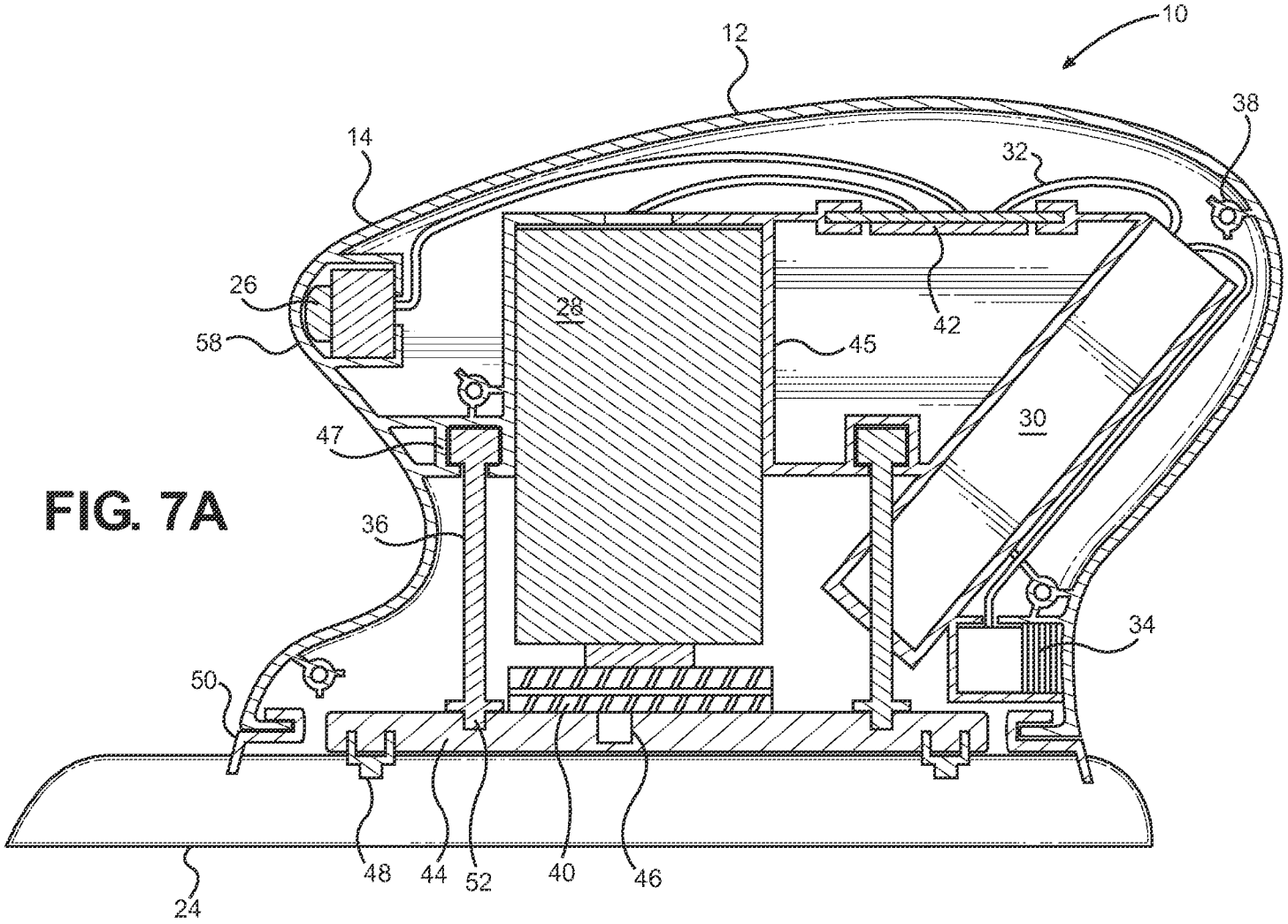
FIG. 7A is a sectioned view in side elevation of a motorized tool according to the invention.
Figure 8A:
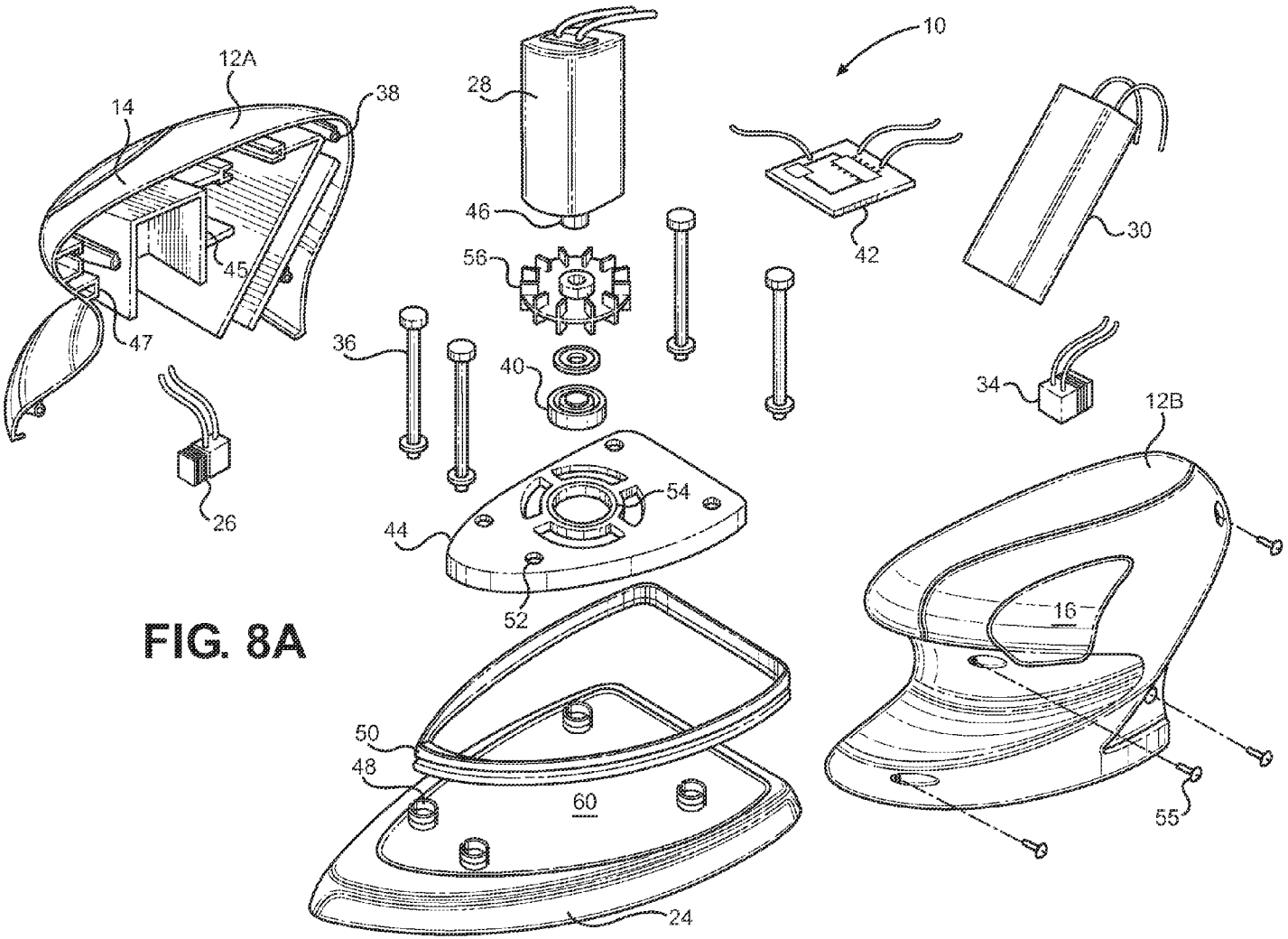
FIG. 8A is an exploded view of the motorized tool of FIG. 7A.

A more detailed understanding of the structure and operation of the motorized tool 10 can be had with further reference to FIGS. 7A and 8A where the tool 10 is shown in cross-sectional and exploded views. There, the tool 10 can be seen to have a motor 28 retained in place by an inner framework 45, which in this example is molded into the housing halves 12A and 12B. The framework 45 additionally retains several other components as described herein. The housing halves 12A and 12B are secured together by a plurality of fasteners 55 received through apertures in the housing half 12B and into threaded bosses 38 in housing half 12A. Of course, the type and power of the motor 28 can vary depending on, among other things, the application and manufacturing costs. In certain embodiments, for example, the motor 28 can be a 12 Volt, brushed DC motor.

The motor 28 is powered by one or more power supplies comprising batteries 30, which again can vary in type and size, through electrical wiring 32. The battery 30, which could be fixed in place or removable and replaceable, is retained in a battery housing 35. The battery 30 could take the form of a lithium polymer battery and will preferably be rechargeable with the inclusion of a recharge induction coil 34. The battery 30 could have a range of 7.4 to 11.1, 14.8, 15.6-18, or even 18.5 Volts depending on the embodiment. An overcharge cutoff circuit can be included in the circuit board 42, which can be interposed within the electrical system for preventing damage due to overcharging and overloads. Although perhaps less preferable, it will be recognized that embodiments of the invention could alternatively or additionally be powered by alternating current, such as through an electrical cord plugged into a power source.

Operation of the motor 28 can be actuated by a switch 26, which in the present embodiment is embedded in the tip 58 of the central gripping section 14. As seen in FIGS. 7A and 8A, the switch 26 can be a depression switch. Alternatively, the switch 58 could be a toggle switch or any other effective type of switch. The motor 28 has an eccentric output rod 46 that is received through a cast alloy flywheel 56 and into a sealed roller bearing 40. The roller bearing 40 in turn is received into a correspondingly shaped aperture 54 in a base plate 44.

Figure 10A:
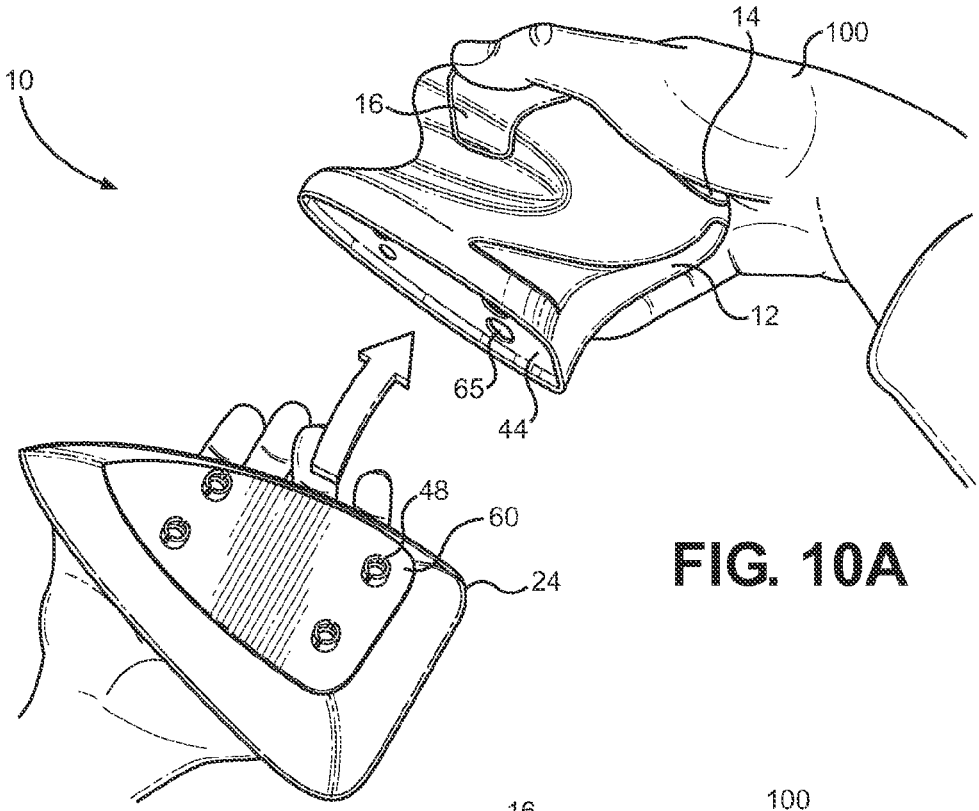
FIG. 10A is a perspective view of a motorized tool with the surface treatment pad about to be snapped into place relative to the housing.

As will be described further hereinbelow, a surface treatment pad 24 is removably and replaceably coupled to the base plate 44. In the embodiment of FIG. 10A, the coupling is by a snap-fit engagement between four resilient, annular engaging protuberances or buttons 48 on the dorsal surface of a base platform 60 of the surface treatment pad 24 in combination with four correspondingly sized and located apertures 65 or indentations in the base plate 44.

Surface treatment pads 24 can thus be selectively removed and replaced, such as when worn or when a different application is desired, by a simple snapping or unsnapping of the pad 24 into or out of engagement with the base plate 44 as suggested by FIG. 10A. It should be noted that the base platforms 60 and the surface treatment pads 24 could be disengaged from the base plate 44 either manually, automatically, or by some combination thereof.

Figure 10B:
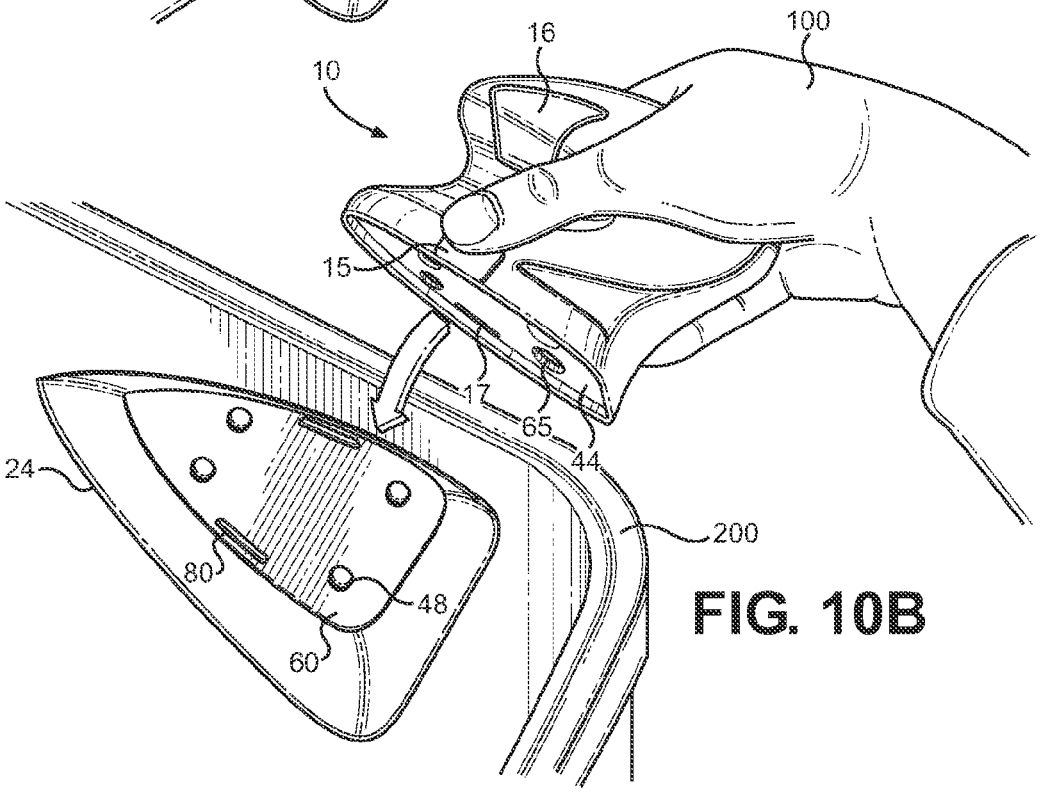
FIG. 10B is a perspective view of the motorized tool ejecting the surface treatment pad into a waste receptacle.

In FIG. 10B, the motorized tool 10 permits ejection of surface treatment pads 24. There, the base platform 60 of the surface treatment pad 24 again has four protuberances 48 that act to stabilize the surface treatment pads 24 and that project dorsally therefrom for being received into correspondingly spaced apertures or indentations 65 in the base plate 44. Here, however, the protuberances 48 are merely received into the indentations 65 for registering the location and orientation of the surface treatment pad 24 relative to the base plate 44. The surface treatment pad 24 is selectively fixed relative to the base plate 44 by a mating engagement between engaging tabs 80 that project dorsally from the lateral edges of the base platform 60 with locking slots 17 disposed in or outboard of the base plate 44. Each locking slot 17 includes a ridge or other locking mechanism for selectively fixing the engaging tabs 80 and thus the surface treatment pad 24 in place. The engaging tabs 80 and the surface treatment pad 24 can be released by a pressing of the release buttons of the gripping portions 15.

Looking again to FIGS. 7A and 8A in combination with FIGS. 1 through 6, operation of an embodiment of the motorized tool 10 can be more fully understood. During use of the motorized tool 10, actuation of the motor 28 by use of the switch 26 will induce an eccentric rotation of the output rod 46. The eccentric movement of the output rod 46 in turn produces an eccentric movement of the roller bearing 40, and the eccentric movement of the roller bearing 40 produces a movement or vibration of the base plate 44, such as an oscillation, a reciprocation, or some other movement. With a surface treatment pad 24 retained relative to the base plate 44, motorized cleaning scrubbing, buffing, and polishing can be carried out with the motorized tool 10 efficiently and effectively with reduced user effort as compared to manual efforts.

As best seen in FIG. 8A, a plurality of flexible rods 36, in this case four rods 36 potentially with rubber end bushings, connect the base plate 44 to the framework 45 by having proximal ends received and retained by housings 47 in the framework 45 and distal ends received into apertures 52 in the base plate 44. The flexible rods 36 thus provide vibration isolation between the vibrating base plate 44 and the remainder of the tool 10.

The housing 12 is preferably watertight to permit use of the motorized tool 10 in wet applications, such as the scrubbing of showers and sinks, in outdoor applications, in marine applications, and in similarly wet environments. In the embodiment of FIG. 8A, for instance, a watertight construction is achieved through a sealed engagement between the housing halves 12A and 12B and through a watertight boot 50 that engages a rim 51 on the bottom portions of the housing halves 12A and 12B and matingly engages a correspondingly shaped and sized channel in the surface treatment pad 24. Moreover, the motor 28 itself can be encased in a waterproof housing formed by the framework 45.

Figure 9:
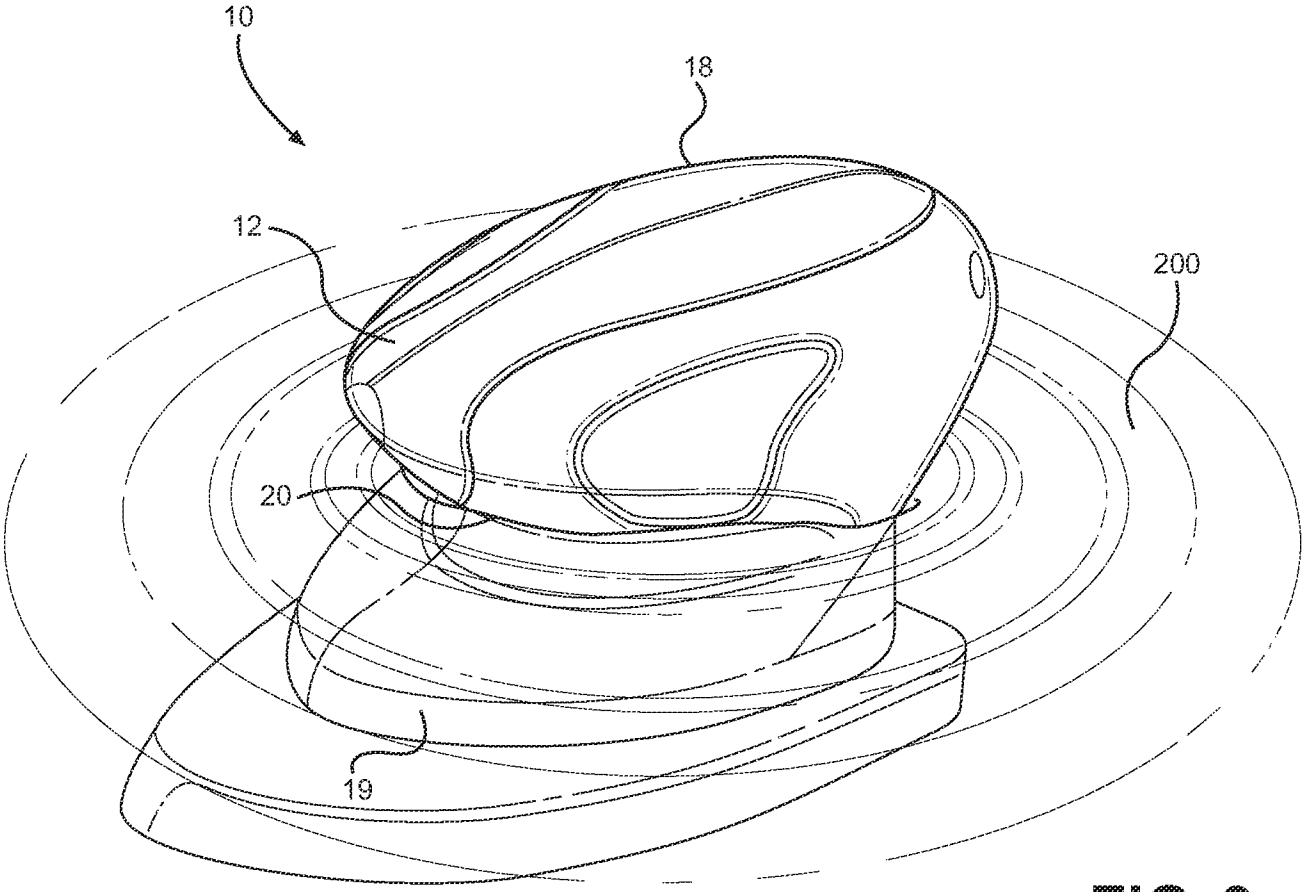
FIG. 9 is a perspective view of a motorized tool as disclosed herein floating in a body of water.

When fully assembled, the motorized tool 10 will preferably have an ingress protection (IP) rating of 6-7 with the number 6 indicating that the tool 10 will lock out all dust particles and the 7 representing that the tool 10 can be submersed in one meter of water for thirty minutes. In preferred embodiments, the motorized tool 10 will be buoyant such that the tool 10 will tend to float in a body of water 200 as shown in FIG. 9. Moreover, embodiments of the tool 10 are contemplated wherein the distribution of mass within the tool 10 is balanced with one or more air pockets formed in the bulbous upper portion 18 such that the tool 10 will float in an upright position with the bulbous upper portion 18 projecting above the surface of the body of water 200 and the base portion 19 disposed therebelow. Other means for inducing sufficient buoyancy can be used in addition or alternatively to the air pocket. For instance, buoyant foam padding can be retained inside or outside of the housing 12. In any event, the cumulative buoyancy established by the means for inducing buoyancy will overcome the weight of the tool 10 to permit the tool 10 to float as described.

Figure 7B:
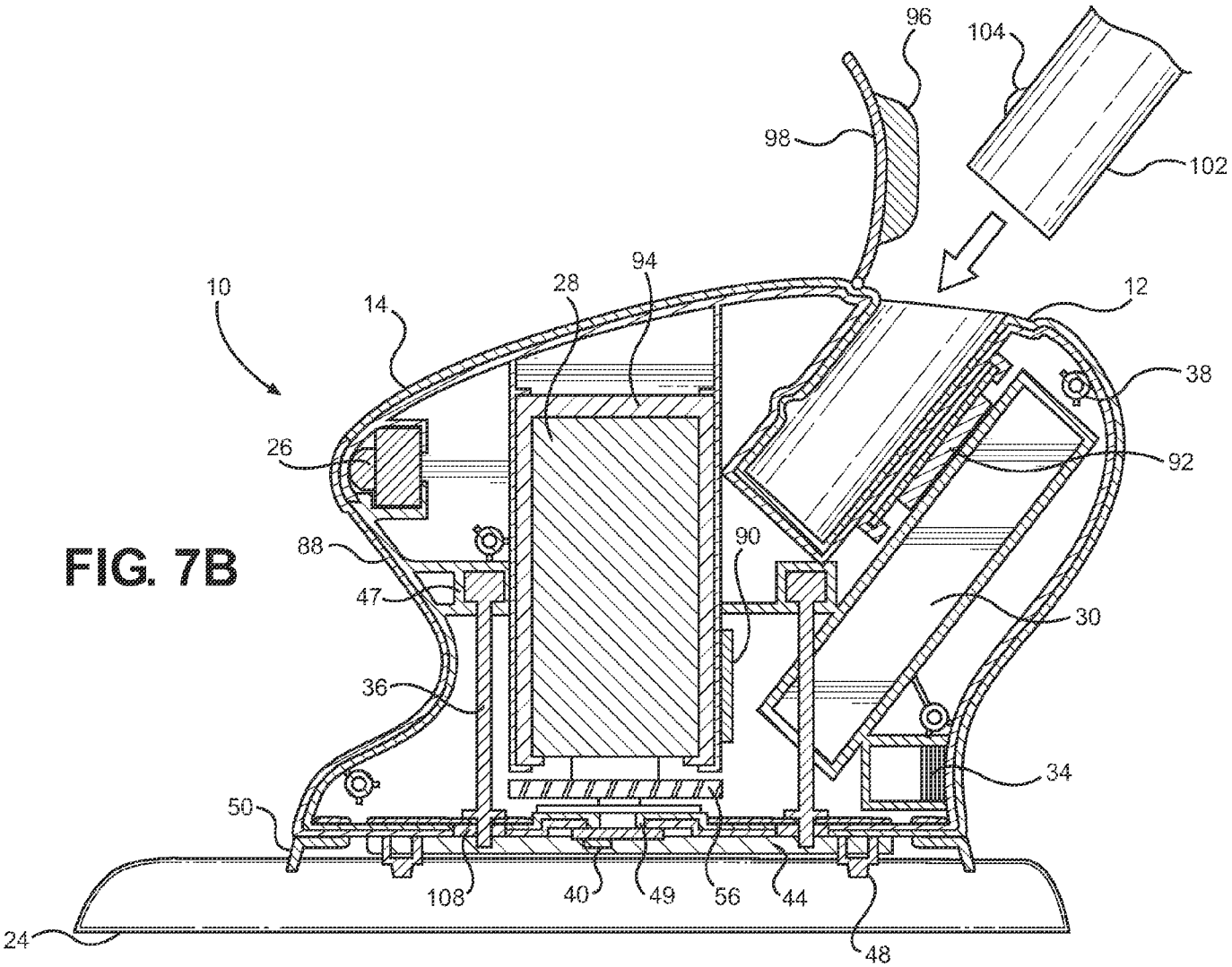
FIG. 7B is a sectioned view in side elevation of an alternative motorized tool as disclosed herein.
Figure 8B:
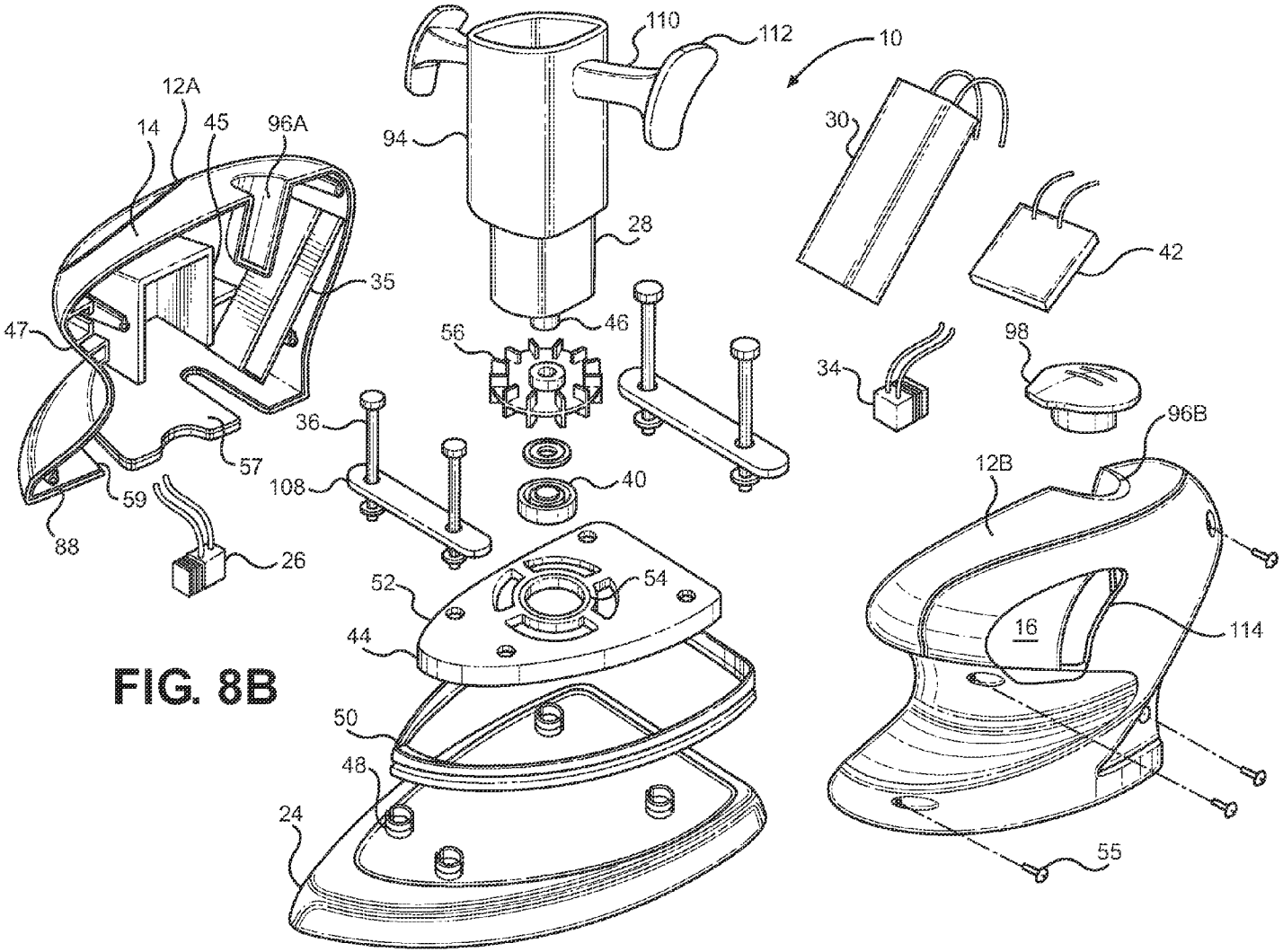
FIG. 8B is an exploded view of the motorized tool of FIG. 7B.

An alternative embodiment of the motorized tool 10 is depicted in FIGS. 7B and 8B. There, the tool 10 again has a motor 28 retained in place by an inner framework 45 that is again molded into the housing halves 12A and 12B. The housing halves 12A and 12B are secured together by a plurality of fasteners 55 received through apertures in the housing half 12B and into threaded bosses 38 in housing half 12A. The motor 28 is powered by one or more batteries 30 that can be rechargeable through a recharge induction coil 34. Overcharging can be prevented by an overcharge cutoff circuit 42. The motor 28 can be actuated by a switch 26, which is again embedded in the tip 58 of the central gripping section 14. The motor 28 has an eccentric output rod 46 that is received through a cast alloy flywheel 56 and into a sealed roller bearing 40. The roller bearing 40 in turn is received into a correspondingly shaped aperture 54 in a base plate 44. A surface treatment pad 24 can again be selectively retained relative to the base plate 44.

Four flexible rods 36 with rubber end bushings connect the base plate 44 to the framework 45 by having proximal ends received and retained by housings 47 in the framework 45 and distal ends received into apertures 52 in the base plate 44. The flexible rods 36 thus provide vibration isolation between the vibrating base plate 44 and the remainder of the tool 10. Here, however, the housing halves 12A and 12B have bottom walls 57 with lateral slots 59 therein through which the flexible rods 36 pass. Elongate sealing membranes 108 comprising flat polymeric members occupy the lateral slots 59 and receive the flexible rods 36 therethrough, a polymeric sealing gasket 88 is interposed between the housing halves 12A and 12B, and a watertight boot 50 engages the bottom of the housing 12. With this, the sealing gasket 88, the sealing membranes 108, and the watertight boot 50 cooperate to form a watertight barrier between the inner volume of the housing 12 and the exterior of the housing 12, including in relation to the base plate 44. A watertight inner compartment is thus established within the housing 12. Accordingly, the base plate 44 can be driven by the motor 28 while remaining fluidically segregated from the watertight inner compartment.

The motorized tool 10 again will preferably have an ingress protection (IP) rating of 6-7 with the number 6 indicating that the tool 10 will lock out all dust particles and the 7 representing that the tool 10 can be submersed in one meter of water for thirty minutes. The motorized tool 10 will preferably be buoyant such that the tool 10 will tend to float in a body of water 200 as shown in FIG. 9 and as described previously.

It will be appreciated that, while the motorized tool 10 has primarily been depicted as being handheld, it is possible and within the scope of the invention for a handle 102 to be additionally or alternatively employed, such as through a threaded connection, a snap-fit connection, or a ball and detent 104 and 106 combination as in FIGS. 7B and 8B. With the provision of such a handle 102, the tool 10 could enjoy still further application in hard to reach or remote locations, such as the upper reaches of a shower, behind a toilet, or a higher portion of a wall.

As shown in FIG. 8B, the housing halves 12A and 12B have first and second receptacle halves 96A and 96B that are molded into the housing halves 12A and 12B and that together form a receptacle 96 as in FIG. 7A. The receptacle 96 is fluidically sealed in relation to the fluidtight inner compartment of the housing 12. A wand handle 102 with a resiliently deflectable ball 104 adjacent to a distal end thereof can be selectively received into the receptacle 96 with the ball 104 engaging with the detent 106. When not in use, the receptacle 96 can be covered by a cap 98, which can be a polymeric cap that is hingedly or otherwise connected to the housing 12 as shown most clearly in FIG. 7B. The wand handle 102 can vary depending on, among other things, the expected application of the motorized tool 10. In one contemplated embodiment, the wand handle 102 comprises telescoping construction of steel, aluminum, plastic, or some other material or combination thereof.

FIGS. 7B and 8B also show a further refinement of the invention in the form of a heat sink housing 94 that envelops all or a portion of the motor 28. The heat sink housing 94 can be formed from a material with a high heat transfer coefficient, such as by being formed of a tightly toleranced, aluminum or similar alloy. The heat sink housing 94 draws heat away from the motor 28. To improve heat removal, heat sink arms 110 project laterally from the heat sink housing 94 and terminate in heat sink surface flanges 112. The flanges 112 can in certain embodiments be in direct contact with or immediately adjacent to the exterior wall surface of the housing 12. In the depicted embodiment, however, the housing 12 has heat sink flange apertures 114 therein that allow the flanges 112 to be exposed to the exterior of the housing 12. The flanges 112 can be formed to establish a continuous, contoured surface with the housing halves 12A and 12B. While two heat sink arms 110 and flanges 112 are shown, it will be understood that more or fewer heat sink arms 110 and flanges 112 could be employed.

Figure 8C:
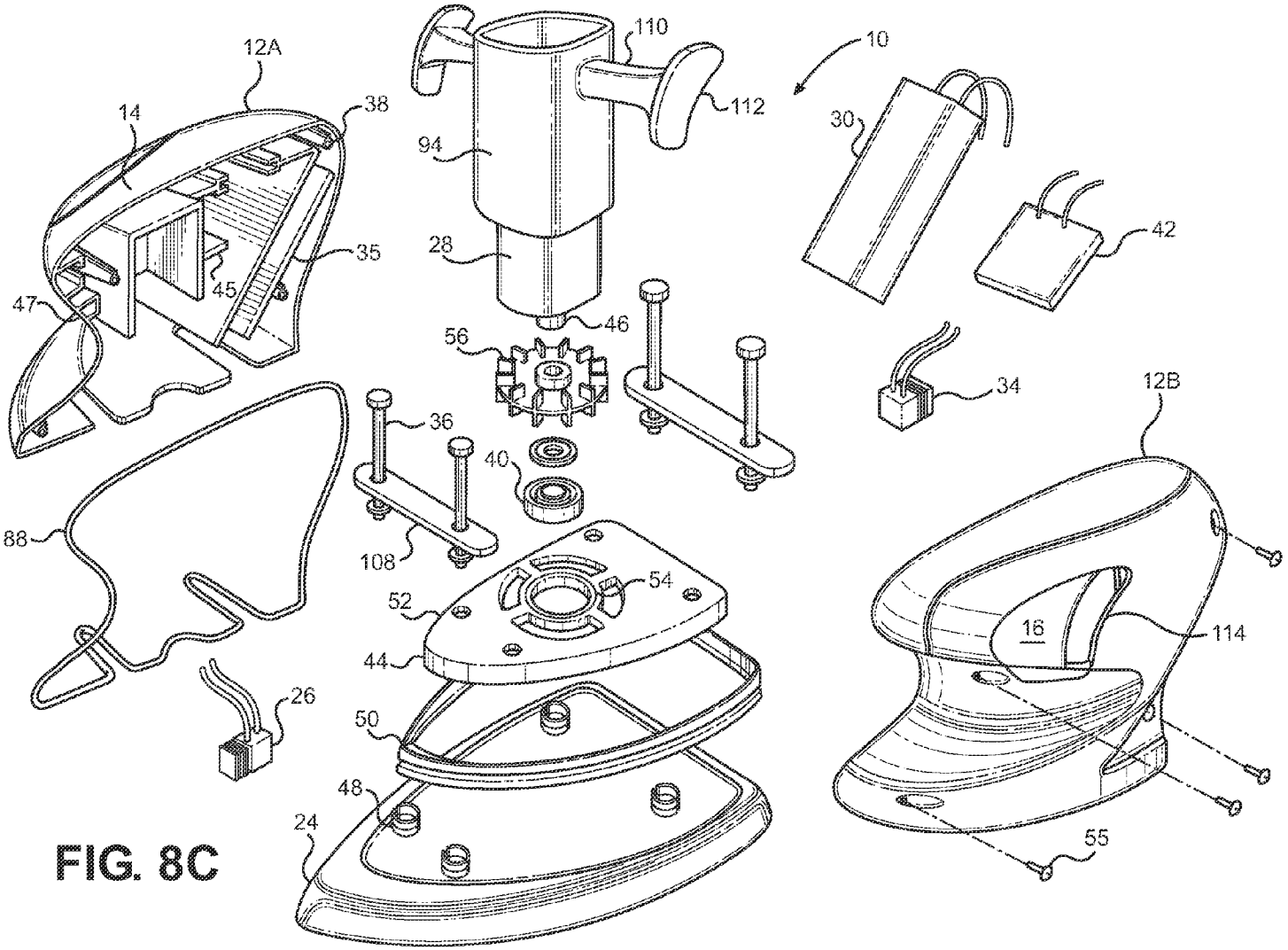
FIG. 8C is an exploded view of another motorized tool pursuant to the invention.

Of course, the heat sink arms 110 and flanges 112 can be readily incorporated into alternative embodiments of the invention. For example, as shown in FIG. 8C, the heat sink housing 94, arms 110, and flanges 112 are again employed in an embodiment where no receptacle 96 is provided. The motorized tool 10 of FIG. 8C again seeks to achieve many of the advantages and functions described previously.

To address the possibility of excessive heat buildup even with the presence of the heat sink arms 110 and flanges 112, the motorized tool 10 of FIG. 7B additionally incorporates a thermal motor sensor switch 90, which is attached to or near the motor housing 94. The thermal motor sensor switch 90 will open the electrical motor circuit to shut down the motor 28 to permit a cooling thereof. Actuation of the thermal motor sensor switch 90 can in certain embodiments incorporate or be in communication with a timer to prevent motor operation for a predetermined period or until a predetermined temperature is reached. An overcharge cut-off circuit 92 can additionally be interposed in the electrical system to prevent excessive charging of the battery 30.

Still further, the motorized tool 10 can incorporate a recharge warning to advise a user of an imminent need for recharging the tool 10. For example, the circuit board 42 can include circuitry to induce a warning when complete battery depletion is approaching within a predetermined time period, such as two minutes. The warning could, for example, comprise a pulsation of the motorized tool 10 a given number of times by an automated powering on and off of the tool 10 during operation. Alternatively, the motor 28 could progressively reduce operational speed in stages in anticipation of a loss in batter power. By way of example, the motor 28 shall begin a slowdown with three minutes of power remaining, a further slowdown with two minutes of power remaining, and then a final slowdown to total cessation of operation with one minute of power remaining.

Figure 11A:
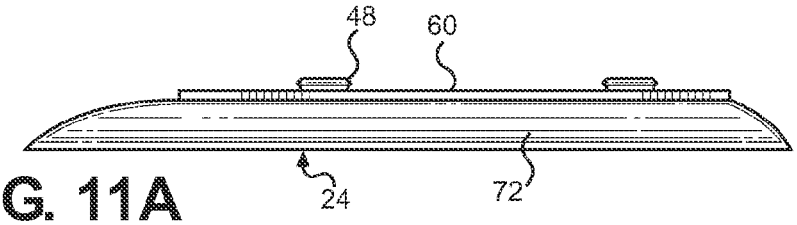
FIGS. 11A and 11B are views in side elevation of surface treatment pads as disclosed herein.
Figure 11B:
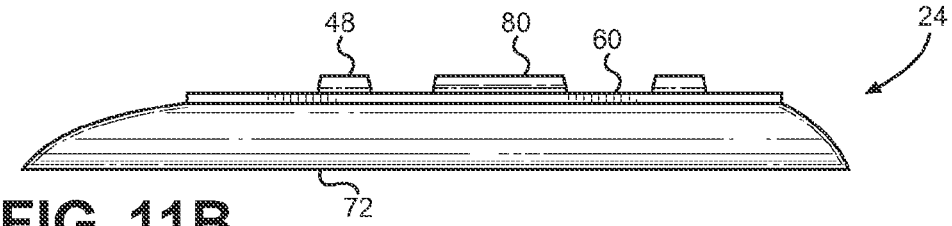
Figure 12A:
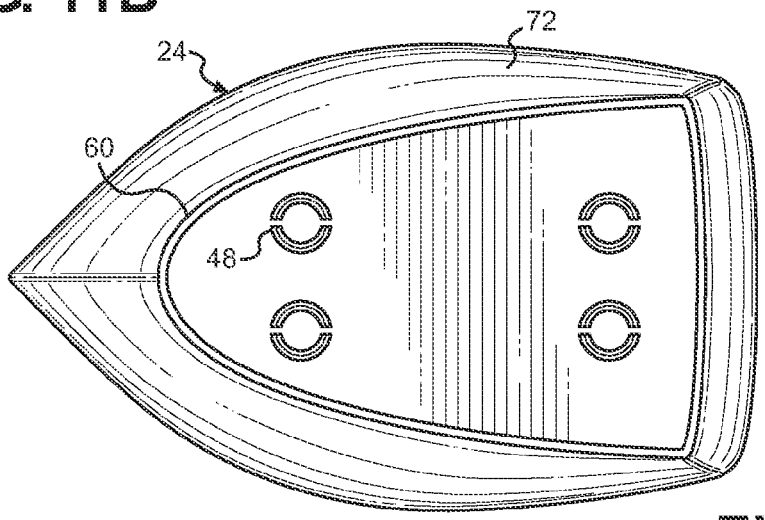
FIGS. 12A and 12B are top plan views of the surface treatment pad of FIGS. 11A and 11B respectively.
Figure 12B:
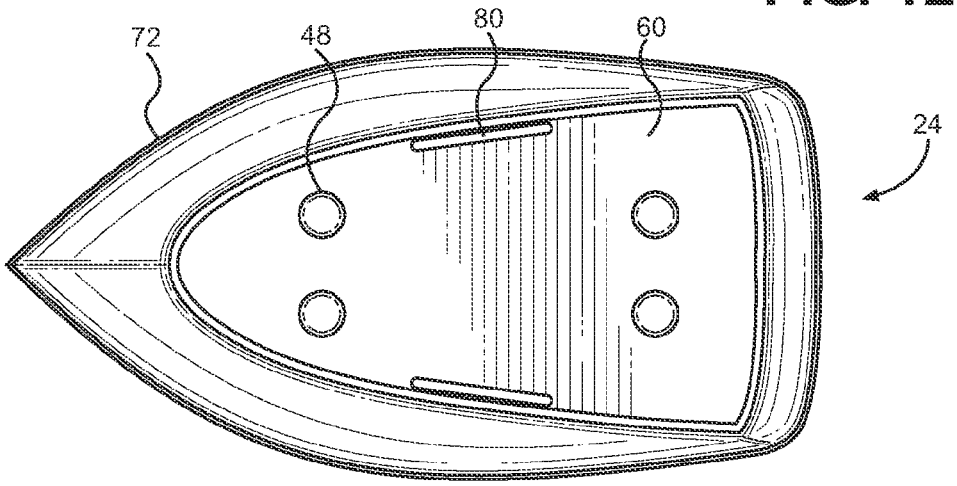

First and second embodiments of surface treatment pads 24 are shown alone in FIGS. 11A and 12A and 11B and 12B respectively. In FIG. 11A, it can be perceived that the surface treatment pad 24 has the base platform 60, which is preferably a rigid member that can be crafted of, for example, plastic, metal, or some combination or variation thereof. Multiple engaging protuberances 48 again project form the dorsal surface of the base platform 60 and a surface engaging member 72 is fixed to the ventral surface of the base platform 60. In FIGS. 11A and 12A, the protuberances 48 are designed for snap-fit engagement. In FIGS. 11B and 12B, the protuberances 48 comprise mere projections, and engaging tabs 80 project from the outboard lateral edges of the base platform 60. In each example, the surface engaging member 72 is generally boat shaped with a pointed anterior end, curved sides, and a rounded posterior end. While details could vary depending on a number of factors, including the application, the sides meet at a substantially 90-degree angle to form the anterior end in this embodiment. The surface engaging member 72 in FIGS. 11A, 11B, 12A, and 12B tapers from its most distal surface toward the base platform 60.

By reference to FIGS. 13A, 13B, 13C, and 13D, one will appreciate that the character of the surface engaging member 72 can vary widely within the scope of the invention depending on the task at hand. By way of example and not limitation, a surface engaging member 72 with plastic bristles forming the surface engaging member 72 as in FIG. 13A could be employed to scrub and otherwise clean pots and pans, stoves, ovens, car wheels, and other surfaces to remove baked-on or caked-on food, road grime, mud, or other debris. A similar surface engaging member 72 could have metal bristles, which could be useful for cleaning barbecue grills, stovetops, oven grills, and similarly tough surfaces. In other embodiments, as in FIG. 13B, the surface engaging member 72 can be formed by a sponge, whether natural or synthetic and of varied coarseness, to clean, for example, tile, stone, pebble, glass, porcelain, stainless steel, or vinyl of kitchens, baths, toilets, showers, sinks, back-splashes, and any other appropriate surface. Suitably chosen sponges or scrunges can easily remove soap-scum, mold and mildew, dirt, grime, grease, water stains, calcium build-up, and other undesirable surface remnants with markedly reduced manual effort by the user as compared to traditional methods. Still further, as seen in FIG. 13C, it is contemplated to provide surface engaging members 72 comprising a fabric, such as a chamois cloth or faux lambskin, stretched over a base member and with rounded and/or flexible edges for polishing or buffing anything from stainless steel appliances, chrome parts on cars and motorcycles, tile, marble, quarts, granite, wood surfaces, including furniture, or any other surface that might be so treated. Additionally, as in FIG. 13D, the surface engaging member 72 comprises a scrungy, abrasive pad, such as might be particularly useful for removing soap scum, mold, mildew, dirt, calcium buildup, and other undesirable material from substantially any surface, wet or dry.

In any event, the preferred surface treatment pads 24 will be dishwasher safe to permit convenient reuse. Moreover, the peripheral edges of the pads 24, including the tip of the pads 24, will preferably be soft and pliable to permit a flexible application and reaching in relation to, for example, corners, sinks, pots, pans, crevices, and innumerable other applications. In practice, replacement surface treatment pads 24 can be sold in variety packs, individually, or with multiple pads 24 of similar design. Surface treatment pads 24 can potentially be manufactured with impregnated detergent, polishing crème, and other surface treatment materials.

Figure 15:
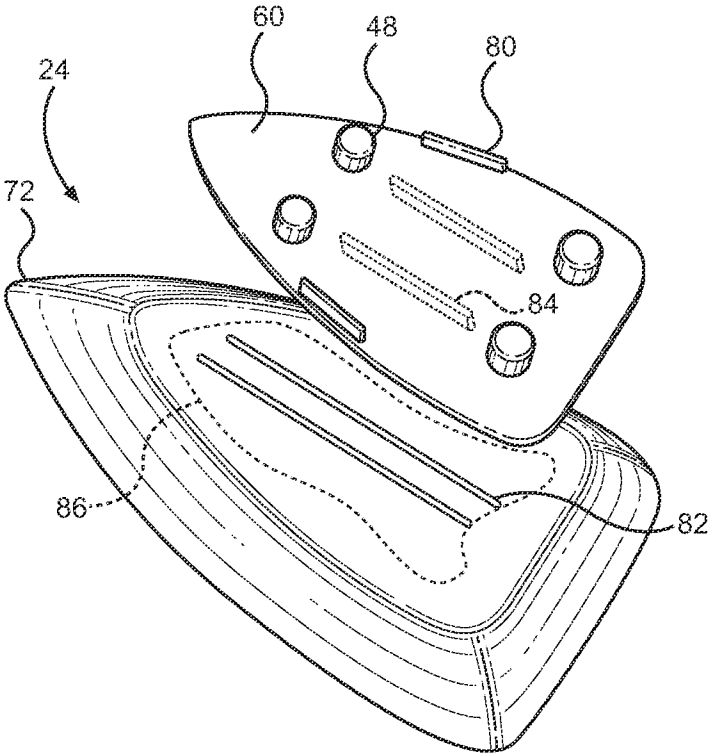
FIG. 15 is a perspective view of an alternative surface treatment pad as disclosed herein.

As noted previously, the surface treatment pads 24 can be manually or automatically discharged from the base plate 44 and the main housing 12 of the tool 10. Further details of the surface treatment pad 24 can be seen in FIG. 15. There, the surface treatment pad 24 again can be seen to have a surface engaging member 72 secured to a base platform 60. Here, however, the surface engaging member 72 can additionally have longitudinal channels 82 therein for receiving correspondingly shaped and located rails 84 that project from the ventral surface of the base platform 60. The rails 84 could be barbed or otherwise formed to positively engage the surface engaging member 72. Moreover, adhesive 86 can be employed to provide a still more durable connection between the member 72 and the platform 60. Also depicted in FIG. 15 are the connection and ejection tabs 80 that are fixed at the outboard edges of the base platform 60. The tabs 80 can be engaged with retention and ejection mechanisms on the housing 12 for permitting secure retention and automatic ejection of the surface treatment pad 24 in a substantially hands-free manner for disposal or cleaning. As noted previously, in such an embodiment, the engaging rings 48 need not necessarily provide a snap-fit and can merely ensure proper orientation and movement.

Figure 14B:
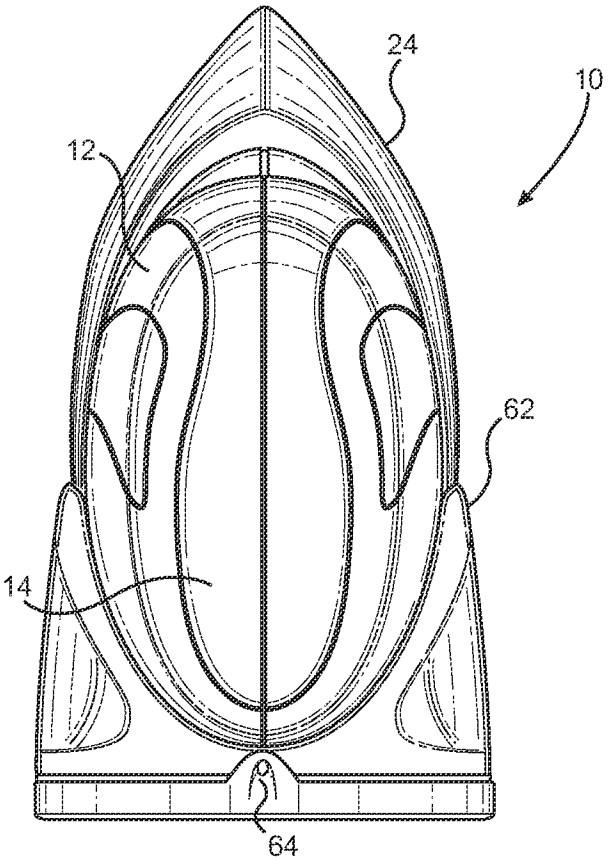
FIGS. 14A, 14B, and 14C are views in side elevation, front elevation, and perspective of the motorized tool and a charging stand therefor.
Figure 14A:
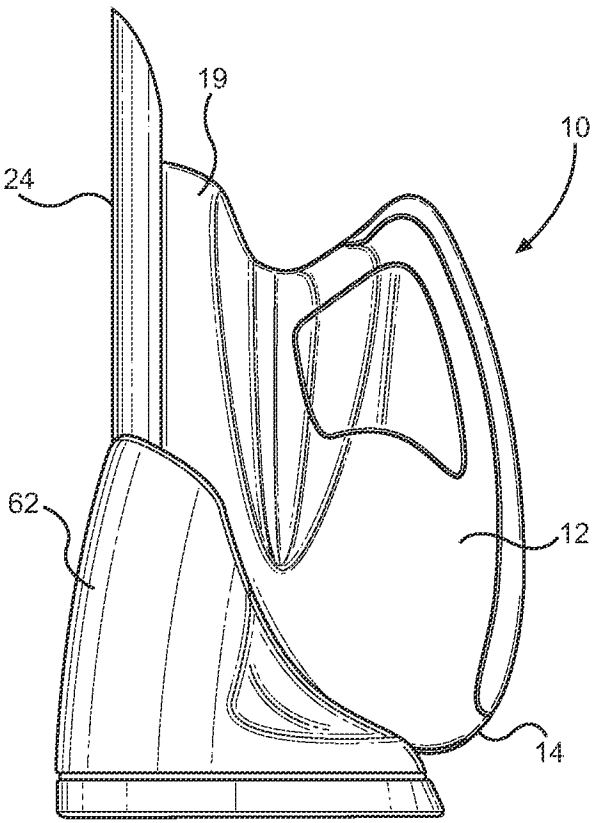
Figure 14C:
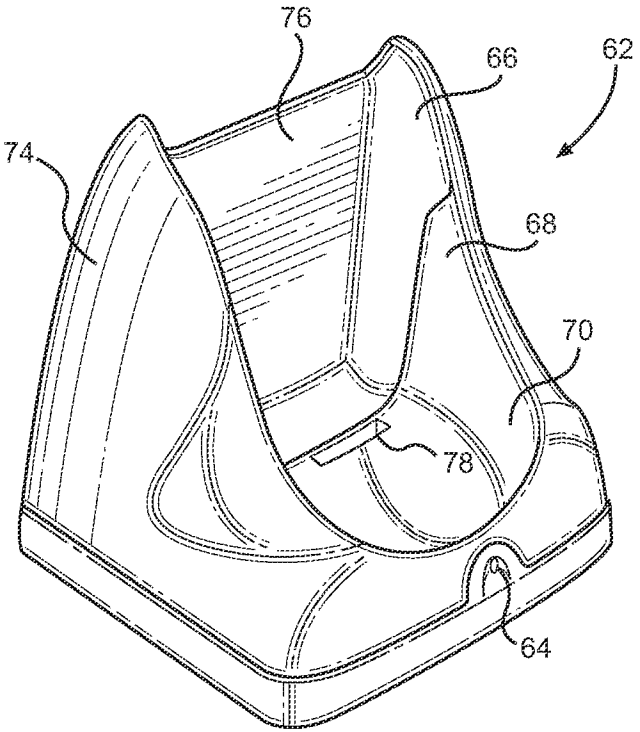

The battery 30 for the tool 10 will preferably be rechargeable. To that end, a correspondingly contoured charging cradle 62 can be provided for receiving, retaining, and recharging the motorized tool 10 as depicted in FIGS. 14A, 14B, and 14C. There, the charging cradle 62 can be seen to have a base housing 74 that has an upstanding base plate 76 for engaging the surface treatment pad 24 or the base plate 44 where the pad 24 is removed. Opposed, ramped lateral slots 66 slidably receive the surface treatment pad 24 when it is attached to the housing 12, but it will be appreciated that the tool 10 can be engaged with the charging cradle 62 with the pad 24 removed therefrom. Opposed lateral retaining ridges 68 matingly engage the opposed charging cradle slots 22 in the housing 12. Electrical contacts 78 transmit recharging power to the battery 30, or the recharging could be done using wireless technology. A status LED light 64 can provide an indication of the charging status of the battery 30. The base of the charging cradle 62 can have a drip basin and/or slot therein, such as at the back thereof, for permitting any residual liquid to drain from the tool pad 24.

Based on the foregoing, it will be clear that the motorized tool 10 can permit cleaning, scrubbing, buffing, polishing and other tasks in wet and dry environments with significantly less effort than under traditional methods while potentially reducing the need for detergents and chemicals. Most household, vehicle, marine, and other cleaning jobs are rendered easier and more convenient with less demand on the body of the user. The user's fingertips, effort, and time are all conserved, and users can save time through added efficiency. The motorized scrubbing, buffing, and polishing tool 10 is multifunctional and subject to innumerable applications without a need for power cords. The vibrating and pulsating household tool 10 can scrub, buff, polish, and clean through electrically charged friction. The tool 10 can clean without scratching and abrade without leaving unsightly marks. The waterproof housing 12 permits use in wet or dry applications, and the preferred construction materials render the housing 12, the gripping surfaces 14 and 16, and the pads 24 impervious to chemicals, such as bleach, acid, and the like.

A further potential refinement of the motorized tool 10 can be understood with additional reference to FIGS. 16A through 16D. There, the motorized tool 10 further includes a reservoir 116 that can be removably engaged with the body portion 12 of the motorized tool 10. The reservoir 116 has a body portion 118 that defines an open inner volume for retaining a volume of material, such as a cleaning fluid, water, or some other volume of liquid, gel, powder, or a combination or variation thereof. The body portion 118 can be formed, such as by blow molding, of a clear, preferably flexible material, such as polyethylene.

The body portion 118 of the reservoir 116 can be considered to have an anterior portion, which retains a dispensing tip 126, and a posterior portion, which retains a filling aperture/cap 128. Material can be added through the filling aperture/cap 128 and dispensed through the dispensing tip 126. The filling aperture/cap 128 and, potentially, the dispensing tip 126 can be threadedly retained such that filling and dispensing can be selectively permitted. The body portion 118 has a central aperture 120 that substantially corresponds in shape to the shape of the recessed portion 20 of the housing 12 and that is defined at its posterior portion by first and second resiliently deflectable legs 122 and 124. With this, the reservoir 116 can be selectively engaged with the body portion 12 by deflecting the legs 122 and 124.

Figure 16B:
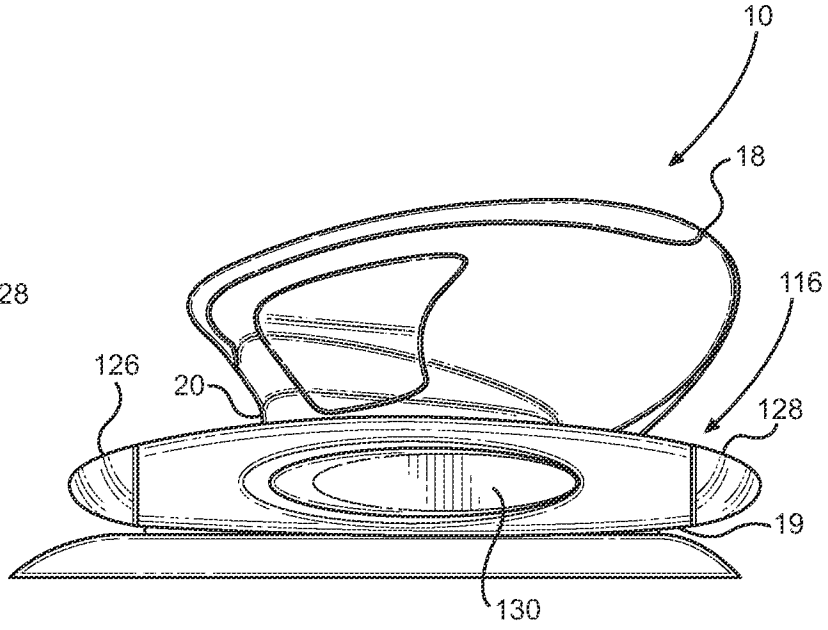
FIG. 16B is a view in side elevation of the motorized tool with a liquid reservoir of FIG. 16A.
Figure 16A:
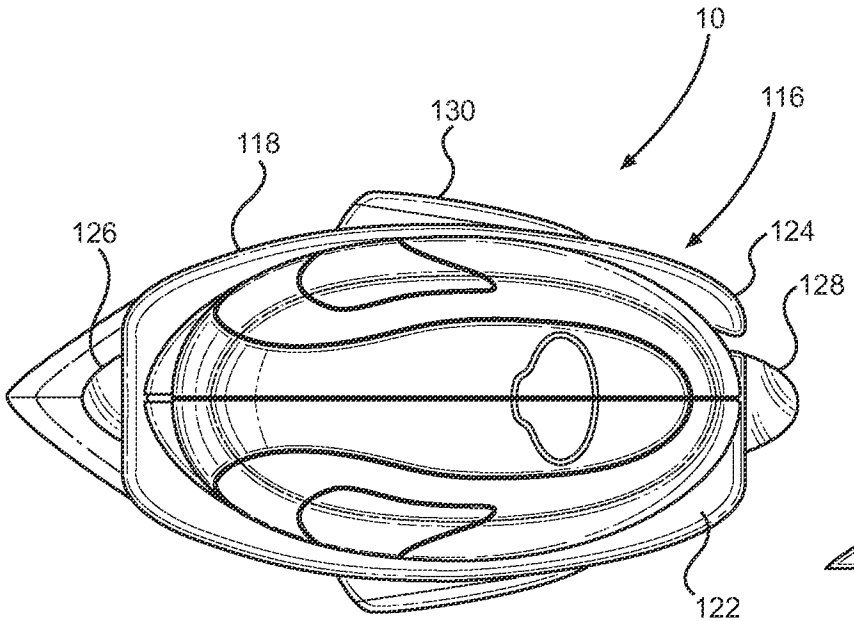
FIG. 16A is a top plan view of a motorized tool with a liquid reservoir.
Figure 16D:
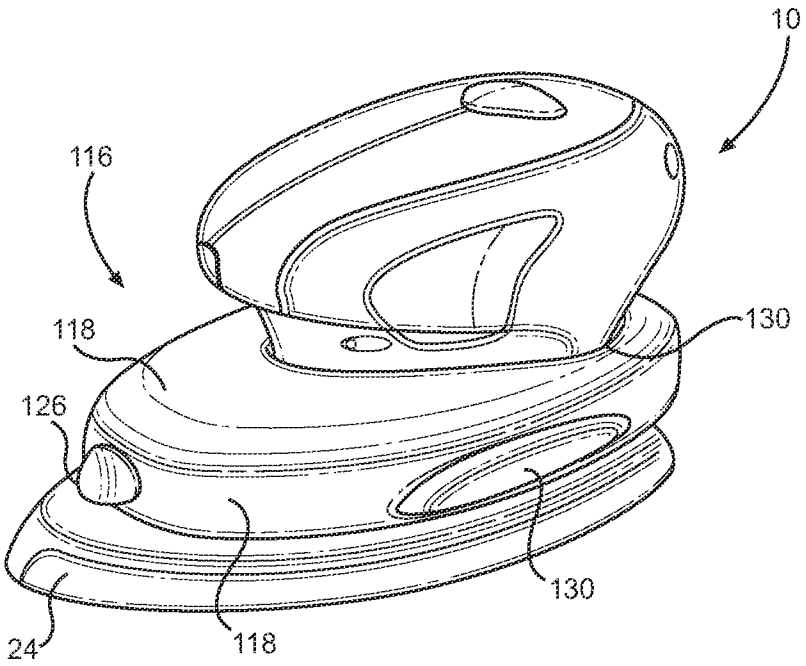
FIG. 16D is a perspective view of the motorized tool with a liquid reservoir.
Figure 16C:
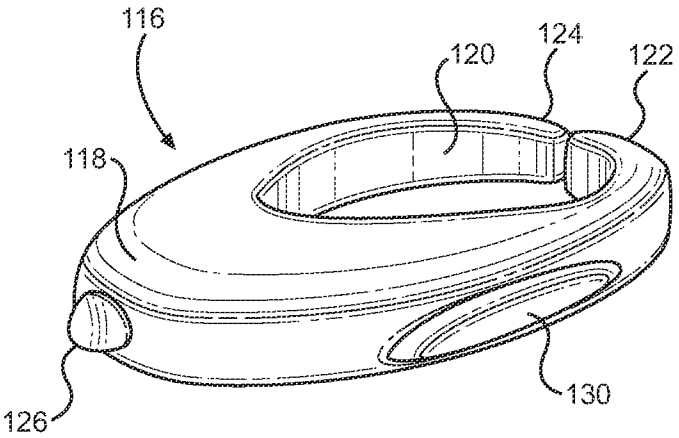
FIG. 16C is a perspective view of the liquid reservoir apart from the motorized tool.

When the reservoir 116 is engaged as in FIGS. 16A, B, and D, the dispensing tip 126 is angled to squirt retained liquid or other material toward a work surface. In certain embodiments, the dispensing tip 126 can be angled and constructed to squirt material at a predetermined angle anterior to the tip of the pad 24, such as between at least two inches and as much as five inches. Where the body portion 118 is flexible, dispensing of retained material can be actuated simply by squeezing or otherwise compressing the body portion. In the depicted embodiment, first and second resilient squeeze buttons 130 with bellows-type sidewalls are disposed along the outboard surfaces of the body portion 118. With that, the buttons 130 can be selectively depressed pressurize the open inner volume of the body portion 118 and thereby to squirt material from the body portion 118 onto a work surface. A one-way valve, such as a soft durometer rubber valve incorporated into the filling aperture/cap 128, can be included to permit the introduction of air when necessary.

With certain details and embodiments of the present invention for a motorized tool 10 disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. A motorized tool for scrubbing, buffing, and polishing, wherein the motorized tool comprises:

a housing with an upper portion, a base portion, a mid-portion disposed between the upper portion and the base portion, a bottom wall with a plurality of apertures therein, and an inner volume that is substantially watertight whereby the tool can be used in wet and dry applications;

a motor retained within the housing;

an electrical power supply for providing electrical power to the motor;

a switch for selectively permitting electrical power to flow from the power supply to the motor;

a base member retained relative to the housing;

an actuation mechanism that moves the base member in response to an operation of the motor;

a retention mechanism capable of retaining a surface treatment pad in relation to the base member;

a release mechanism that selectively releases a surface treatment pad from the base member;

a plurality of flexible rods, each with a first end retained by the housing, a second end retained by the base member, and a body portion wherein the plurality of flexible rods cooperate to provide vibration isolation between the base member and the housing; and a watertight barrier comprising at least one sealing membrane disposed in the plurality of apertures in the bottom wall of the housing between the inner volume and the base member wherein the body portions of the flexible rods pass from within the inner volume, through the apertures in the bottom wall of the housing, and through the at least one sealing membrane between the inner volume and the base member.

2. The motorized tool of claim 1 wherein the electrical power supply comprises at least one rechargeable battery and further comprising means for providing a recharge warning regarding an imminent need for recharging the battery wherein the means for providing a recharge warning comprises a means for altering an operation of the motor dependent on a charge status of the battery.

3. The motorized tool of claim 1 further comprising a surface treatment pad retained by the base member wherein the upper portion of the housing terminates anteriorly in a tip and wherein the surface treatment pad projects anteriorly to the tip when the tool is disposed with the surface treatment pad resting on a work surface.

4. The motorized tool of claim 1 wherein the upper portion comprises a bulbous knob and the mid-portion comprises a recessed portion between the upper portion and the base portion whereby the tool can be gripped by the upper portion.

5. The motorized tool of claim 4 further comprising a central textured gripping section and first and second lateral textured gripping sections retained relative to the housing wherein the central gripping section spans from the top of the upper portion of the housing beyond a midpoint of the housing and anteriorly to overlie the anterior portion of the upper portion, wherein the first and second lateral gripping sections are disposed to opposite sides of the upper portion of the housing and span above and below a broadest localized portion of the upper portion, and wherein the textured gripping sections comprise a high friction material.

6. A motorized tool for scrubbing, buffing, and polishing, wherein the motorized tool comprises:

a housing with an upper portion, a base portion, and a mid-portion disposed between the upper portion and the base portion;

a motor retained within the housing;

an electrical power supply for providing electrical power to the motor;

a switch for selectively permitting electrical power to flow from the power supply to the motor:

a base member retained relative to the housing;

an actuation mechanism that moves the base member in response to an operation of the motor;

a retention mechanism capable of retaining a surface treatment pad in relation to the base member;

a release mechanism that selectively releases a surface treatment pad from the base member, the release mechanism comprising at least one release button disposed on the housing that permits a selective release of a surface treatment pads for cleaning or replacement wherein the at least one release button is disposed along the base portion of the housing and wherein the at least one release button comprises a textured gripping section comprising a high friction material.

7. The motorized tool of claim 6 further comprising a surface treatment pad and a base platform fixed to the surface treatment pad wherein the retention mechanism comprises at least one engaging tab that projects dorsally from either the base platform or the housing in combination with at least one correspondingly located locking slot retained by the other of the base platform and the housing and wherein the at least one release button selectively releases the at least one engaging tab from the at least one locking slot.

8. The motorized tool of claim 6 wherein the housing has an inner volume that is substantially watertight whereby the tool can be used in wet and dry applications.

9. A motorized tool for scrubbing, buffing, and polishing, wherein the motorized tool comprises:

a housing with an upper portion, a base portion, and a mid-portion disposed between the upper portion and the base portion;

a motor retained within the housing;

an electrical power supply for providing electrical power to the motor;

a switch for selectively permitting electrical power to flow from the power supply to the motor:

a base member retained relative to the housing;

an actuation mechanism that moves the base member in response to an operation of the motor:

a retention mechanism capable of retaining a surface treatment pad in relation to the base member; and a plurality of flexible rods, each with a first end retained by the housing, a second end retained by the base member, and a body portion that passes from within the inner volume and through a watertight barrier between the inner volume and the base member wherein the plurality of flexible rods cooperate to provide vibration isolation between the base member and the housing.

10. The motorized tool of claim 9 wherein the watertight barrier comprises at least one sealing membrane.

11. The motorized tool of claim 10 further comprising a watertight boot interposed between the base member and the housing.

12. The motorized tool of claim 11 wherein the housing comprises first and second housing halves and further comprising means for joining the first and second housing halves to form the housing and a sealing gasket interposed between the first and second housing halves to create a watertight relationship between the first and second housing halves wherein the first and second housing halves have bottom walls with slots therein through which the flexible rods pass and in which the at least one sealing membrane is received.

13. The motorized tool of claim 6 wherein the motorized tool is buoyant whereby the tool will tend to float in a body of water.

14. The motorized tool of claim 13 wherein the tool is balanced such that the tool floats in an upright position with the upper portion projecting above a surface of the body of water and the base portion disposed below the surface of the body of water.

15. A motorized tool for scrubbing, buffing, and polishing, wherein the motorized tool comprises:

a housing with an upper portion, a base portion, and a mid-portion disposed between the upper portion and the base portion;

a motor retained within the housing;

an electrical power supply for providing electrical power to the motor;

a switch for selectively permitting electrical power to flow from the power supply to the motor;

a base member retained relative to the housing;

an actuation mechanism that moves the base member in response to an operation of the motor;

a retention mechanism capable of retaining a surface treatment pad in relation to the base member;

a handle and a receptacle in the housing for selectively receiving the handle.

16. The motorized tool of claim 15 wherein the housing comprises first and second housing halves joined to form the housing, wherein first and second receptacle halves are formed in the housing halves, and wherein the first and second receptacle halves together form the receptacle.

17. The motorized tool of claim 15 wherein the housing has a fluidtight inner compartment and wherein the receptacle is fluidically sealed in relation to the fluidtight inner compartment of the housing.

18. A motorized tool for scrubbing, buffing, and polishing, wherein the motorized tool comprises:

a housing with an upper portion, a base portion, and a mid-portion disposed between the upper portion and the base portion;

a motor retained within the housing;

an electrical power supply for providing electrical power to the motor;

a switch for selectively permitting electrical power to flow from the power supply to the motor;

a base member retained relative to the housing;

an actuation mechanism that moves the base member in response to an operation of the motor;

a retention mechanism capable of retaining a surface treatment pad in relation to the base member; and a heat sink in thermal communication with the motor and further comprising at least one heat sink arm that projects from the heat sink wherein the at least one heat sink arm terminates adjacent to an exterior of the housing.

19. The motorized tool of claim 18 wherein the housing has a heat sink aperture and wherein the at least one heat sink arm is exposed to an exterior of the housing through the heat sink aperture.

20. The motorized tool of claim 19 wherein the at least one heat sink arm terminates in a heat sink flange and wherein the heat sink flange establishes a continuous, contoured surface with the housing.

21. The motorized tool of claim 18 wherein the electrical power supply comprises at least one battery and further comprising a recharge warning system that provides a warning regarding an imminent need for recharging the battery wherein the recharge warning system alters operation of the motor dependent on a charge status of the battery.

22. The motorized tool of claim 18 further comprising a thermal motor sensor switch in thermal communication with the motor to prevent motor operation during predetermined temperature-related conditions.

23. The motorized tool of claim 18 further comprising a surface treatment pad with a surface engaging member wherein the surface engaging member is generally boat shaped with a pointed anterior end, curved sides, and a posterior end.

24. The motorized tool of claim 18 wherein the electrical power supply comprises at least one rechargeable battery and further comprising means for recharging the battery wherein the means for recharging the battery comprises a charging cradle in combination with cradle slots in the housing.

25. A motorized tool for scrubbing, buffing, and polishing, wherein the motorized tool comprises:

a housing with an upper portion, a base portion, and a mid-portion disposed between the upper portion and the base portion;

a motor retained within the housing;

an electrical power supply for providing electrical power to the motor;

a switch for selectively permitting electrical power to flow from the power supply to the motor;

a base member retained relative to the housing;

an actuation mechanism that moves the base member in response to an operation of the motor;

a retention mechanism capable of retaining a surface treatment pad in relation to the base member; and a reservoir with a body portion removably engaged with the body portion of the motorized tool wherein the reservoir has an open inner volume for retaining a volume of material and a dispensing tip for dispensing material from the open inner volume.

26. The motorized tool of claim 25 wherein the reservoir has first and second resiliently deflectable legs and a central aperture in the body portion.

27. The motorized tool of claim 26 wherein the reservoir further comprises at least one button that can be pressed to pressurize the reservoir and to dispense material from the reservoir through the dispensing tip.

* * * * *